US007657054B2

(12) United States Patent
Phillips

(10) Patent No.: US 7,657,054 B2
(45) Date of Patent: Feb. 2, 2010

(54) APPARATUS AND METHODS FOR FORMING SHOE INSERTS

(75) Inventor: Edward H. Phillips, Troy, MI (US)

(73) Assignee: Footcontrolle, LLC, Troy, MI (US)

( * ) Notice: Subject to any disclaimer, the term of this patent is extended or adjusted under 35 U.S.C. 154(b) by 1088 days.

(21) Appl. No.: 10/524,093

(22) PCT Filed: Aug. 20, 2003

(86) PCT No.: PCT/US03/26066

§ 371 (c)(1),
(2), (4) Date: Feb. 9, 2005

(87) PCT Pub. No.: WO2004/017813

PCT Pub. Date: Mar. 4, 2004

(65) Prior Publication Data

US 2006/0076700 A1 Apr. 13, 2006

Related U.S. Application Data

(60) Provisional application No. 60/405,264, filed on Aug. 22, 2002.

(51) Int. Cl.
*G06K 9/00* (2006.01)
*A43B 13/22* (2006.01)

(52) U.S. Cl. ..... 382/100; 36/73; 36/83

(58) Field of Classification Search ..... 382/100, 382/111; 36/83–106, 43–44, 73–74, 154
See application file for complete search history.

(56) References Cited

U.S. PATENT DOCUMENTS 2,092,910 A * 9/1937 Daniels ..... 36/154
2,206,029 A * 7/1940 Daniels ..... 36/154
3,320,347 A 5/1967 Greenawalt
3,355,535 A * 11/1967 Hain et al. ..... 264/321
3,535,211 A * 10/1970 Frowde ..... 205/67
3,738,427 A * 6/1973 Fryrear et al. ..... 168/4
3,818,617 A * 6/1974 Dassler et al. ..... 36/32 R
4,006,542 A * 2/1977 Larson ..... 36/43
4,155,180 A * 5/1979 Phillips ..... 36/129
4,183,156 A * 1/1980 Rudy ..... 36/44
4,258,480 A * 3/1981 Famolare, Jr. ..... 36/91
4,316,334 A * 2/1982 Hunt ..... 36/91

(Continued)

FOREIGN PATENT DOCUMENTS

EP 71386 A2 * 2/1983

*Primary Examiner*—Manav Seth
(74) *Attorney, Agent, or Firm*—Gifford, Krass, Sprinkle, Anderson & Citkowski, P.C.

(57) ABSTRACT

Foot impression generating apparatus comprising impression platforms including buns of open-cell sponge material bonded to an supporting non-porous skins formed of non-blown sponge material is utilized for making foot impressions by a consumer. The sponge material comprises a blended mixture of elastomeric thermosetting material and low melting temperature thermoplastic material chosen such that the buns and skins are respectively flexible and then become rigid when heated and then cooled above and below the plastic temperature range of the thermoplastic material. The consumer steps into heated impression platforms to form the foot impressions and then they are cooled and "frozen" in place. Next, scanning means are used to create a digital contour map of the foot impressions. Then a digitally controlled milling machine is utilized for forming shoe inserts in conformance with the digital contour map.

8 Claims, 10 Drawing Sheets

U.S. PATENT DOCUMENTS 4,413,429 A * 11/1983 Power ..... 36/44
4,441,499 A * 4/1984 Comparetto et al. ..... 36/154
4,450,122 A * 5/1984 Gallina ..... 264/46.6
4,481,726 A * 11/1984 Phillips ..... 36/30 A
4,510,636 A * 4/1985 Phillips ..... 12/1 R
4,516,069 A * 5/1985 Schmanski ..... 324/71.1
4,517,696 A * 5/1985 Schartz ..... 12/1 R
4,747,989 A * 5/1988 Peterson ..... 264/223
5,101,580 A * 4/1992 Lyden ..... 36/93
5,282,328 A * 2/1994 Peterson ..... 36/154
5,316,545 A * 5/1994 Cherubini ..... 602/7
5,555,584 A * 9/1996 Moore et al. ..... 12/142 N
5,640,779 A 6/1997 Rolloff et al.
5,733,647 A * 3/1998 Moore et al. ..... 428/304.4
5,787,608 A * 8/1998 Greenawalt ..... 36/11.5
5,829,171 A * 11/1998 Weber et al. ..... 36/93
5,891,545 A 4/1999 Delude
6,006,412 A 12/1999 Bergmann et al.
6,042,759 A * 3/2000 Marshall ..... 264/40.1
6,231,527 B1 * 5/2001 Sol ..... 600/595
6,346,210 B1 * 2/2002 Swartz et al. ..... 264/486
6,510,626 B1 * 1/2003 Greenawalt ..... 36/43
6,708,644 B2 * 3/2004 McNamara ..... 116/207

* cited by examiner compressionally distort the digitized foot impression or impressions data comprised in the set or sets of data representative of the contours of a consumer's foot impressions 18 taken at the lessor trailing portion angle 30 or angles 30 over the rear portion of the distance from the great toe metatarsal heads to the rear of the heels such that the resulting distance between the great toe metatarsal heads and the rear of the heels comprised in the set or sets of the so modified digitized foot impression data is or are equal to that of the set of data representative of the contours of the consumer's foot impressions 18 taken at the greater trailing portion angle 30

↓ position the sets of so modified digitized foot impression data progressively along the longitudinal axis of the composite set of digitized foot impressions 90 with the digitized data from the set of data representative of the contours of the consumer's foot impressions taken at the largest trailing portion angle 30 positioned forwardly and those taken at the smallest trailing portion angle 30 rearwardly with the respective sets of digitized data generally disposed to either side of a mean average angularly skewed line or lines extending from inside to outside of the composite set of digitized foot impressions in a generally forward direction or directions

↓ establish transition zones on either side of the mean average line or lines such that there is a smooth transition between digitized data from the set of data representative of the contours of the consumer's foot impressions taken at the largest trailing portion angle 30 generally present from the forward portion of the instep through the forefoot supporting regions to digitized data from the set of data representative of the contours of the consumer's foot impressions taken at the smallest trailing portion angle 30 generally present from the rear of the fifth metatarsal through the heel regions, with the fully implemented composite set of digitized foot impressions along with the consumer's identification, shoe type and size, and any supplemental elevation angle 30' utilized in a personal file ready for use in shoe insert generating apparatus

FIG. 10

APPARATUS AND METHODS FOR FORMING SHOE INSERTS

RELATED APPLICATION

This application claims priority of U.S. Provisional Patent Application Ser. No. 60/405,264 filed Aug. 22, 2002, which is incorporated herein by reference.

BACKGROUND OF THE INVENTION

The present invention relates generally to improved methods for taking impressions of the feet and then forming custom-made shoe inserts in conformance with those foot impressions, and more particularly, to forming full-length impressions of the feet that are useful in the process of forming shoe inserts suitable for providing accurate full foot length support for a consumer's feet when inserted into that consumer's shoes in order to produce semi-custom footwear solely intended for him or her.

One known method of taking foot impressions wherein a person steps onto a foot impression unit comprising a bed of pneumatically supported pins is disclosed in U.S. Pat. No. 4,876,758 dated Oct. 31, 1989 and entitled "System and Method for Forming Custom-Made Shoe Inserts" by Paul D. Rolloff et al, and assigned to Amfit Inc. then located in Sunnyvale, Calif. and now located in Santa Clara, Calif. In detail, this method of taking foot impressions comprises the steps of: applying pneumatic support to the bed of pins; stepping onto the bed of pins; locking the pins in place; digitally recording and storing positions of the pins thereby generating a digitally recorded negative model of the person's foot contour as impressed in the pins; and then forming shoe inserts in a "shaping unit" in nominal conformance with the digitally recorded negative model of the person's foot contour as impressed in the pins. Another method of making foot impressions wherein a person steps into crushable foam media contained within a simple rectangular box is also known.

Unfortunately, neither of these methods is very accurate. This is primarily because in either case all portions of the feet are subjected to essentially the same supporting pressure with the result that foot displacement is limited only by the heel and other bony weight bearing structure physically coming in contact with a rigid supporting structure. This results in macro foot impression errors wherein the bony weight bearing structure is substantially coplanar while soft tissue portions of the feet are positioned in an indeterminate manner. However, because of further reference made below to the '758 patent, it is expressly incorporated herein by reference.

In a totally different vein, most podiatrists insist that the only proper way to take an accurate foot impression is to "lock" the metatarsus of a foot in position and then form a negative casting of trailing portions of the foot while it is in that locked position. Typically, the metatarsus is so locked by forcibly elevating the lessor toes while the casting process is ongoing. Then a positive casting is made from the negative casting. Next a rigid or semi-rigid insert conforming to trailing foot portions of the positive casting is made. Generally, rigid or semi-rigid inserts are formed of a thermoplastic material wherein sheets of the thermoplastic material are draped over such positive castings in an oven and allowed to conform to the positive castings of their own weight and thus generate trailing portion semi-finished rigid or semi-rigid inserts. After the semi-finished rigid or semi-rigid inserts are removed from the oven and cut to size, they are usually combined with full foot length layers of compliant material and hand formed into a pair of shoe inserts the podiatrists refer to as "orthotics".

There are two serious problems with the above-described procedure utilized by the podiatrists. Most obviously, the process doesn't include any modeling the forefoot portions of the feet at all. As a result, no corrective provision can be made for relatively common maladies such as pronation wherein the great toe metatarsal head should be elevated, or Morton's toe wherein at least the second metatarsal head is more forwardly positioned and usually depressed relative to the first metatarsal head.

Even more seriously however, the podiatrist is actually distorting the foot as he or she forcibly elevates the lessor toes. The metatarsus is locked in a position wherein the fifth and perhaps even the fourth metatarsals are elevated and the first is severely depressed. This results in the first or great metatarsal head being significantly depressed which in turn results in an exaggerated arch. It also results in excessive relative roll axis distortion in the placement of the heel with reference to the metatarsal heads where an axis through the metatarsal heads falls inward even as the heel rolls outward. This can lead to all sorts of leg, hip and back problems. In fact, the above described process is flawed to such a degree that it is common for podiatrists to purposely introduce impression errors such as by adding additional metatarsal support in an effort to overcome anticipated complaints by their patients. It is even common to encounter podiatrists adding wads of adhesive backed cotton to metatarsal areas of seriously flawed shoe inserts.

A far more accurate hand method of taking a person's full-length foot impressions was disclosed in U.S. Pat. No. 4,155,180 dated May 22, 1979 and entitled "Footwear for More Efficient Running". In detail, the hand method of taking full-length foot impressions described in the '180 patent comprised the steps of: stacking two pieces of elastomeric polyurethane foam media having a density of about 5 lbs./cu.ft. with the upper piece being about 1 inch thick and the lower piece being about 3 inches thick; stretching a first sheet of flexible plastic film material of about 0.001 inch thickness over the top piece of elastomeric polyurethane foam media; pouring a pool of plaster of Paris casting material in the center portion of the flexible plastic film material; stretching a second sheet of the plastic film material over the plaster of Paris; the person stepping into the second sheet of plastic film material covering the plaster of Paris; the person holding this position until the plaster of Paris solidifies thus forming a negative casting of his or her feet; the person carefully removing his or her weight and feet from the platform; and utilizing the negative casting as a mold for forming a positive casting of his or her feet. The positive casting was then utilized in a hand process of making a pair of shoe inserts therefrom as further described in the '180 patent.

However, in actual practice it was very difficult to form the negative casting without cracking it. Furthermore, even though the elastomeric polyurethane foam media supported the feet in a substantially linear manner as specifically opposed to the non-linear support provided by either of the foot impression unit of the '758 patent or the crushable foam media, the relatively large thickness of the two superimposed pieces thereof in combination with inadequate load bearing capability of the toes still resulted in outer forefoot portions of the feet being displaced upward from their preferred positions. As a consequence of such foot impression flaws, forming shoe inserts by this process entailed considerable handwork and was thus problematic. As a result of these practical problems, the procedure disclosed in the '180 patent was never reduced to practice commercially.

As a result of the various flaws inherent in all of the other above described procedures and similar flaws involved in other known procedures not specifically mentioned hereinabove, many individuals have found it necessary to modify their shoe inserts in order to get successful results. In particular, this includes runners who must selectively build up or relieve various portions of their shoe inserts in order to avoid foot, knee, leg, hip and/or lower back pain when running. Depending upon which type of shoe insert the individual has, such modifications can include mid-foot and/or arch areas, and/or areas just forward of the metatarsal heads and under the toes. Such modifications are of course most undesirable because of the obvious inaccuracies involved.

It is in fact believed herein that it is simply not possible to obtain really acceptable shoe inserts from any source at this time. For instance, the present inventor has in his possession commercially and professionally obtained shoe inserts such as those mentioned above, as well as positive castings from which his "orthotics" were made and positive castings made from his foot impressions formed in crushable foam media. None of these shoe inserts or positive castings remotely conform to one another and all are in equally gross non-conformance with various foot inserts made for a range of activities according to the teachings presented hereinbelow and believed herein to support the present inventor's feet in as anatomically correct a manner as is possible for the respective activities.

It has been found that no one set of shoe inserts is optimum for use in all shoes or for all activities. Firstly, various brands and types of shoes are made on different lasts, and their resulting different internal shapes deleteriously modify foot support derived from any presently known type of shoe insert. Secondly, feet dynamically change shape depending upon their instant disposition. Thus, shoe insert contours optimally formed for relatively sedentary activities such as walking are totally unsuited for more dynamic activities such as running.

The object of the present invention then, is to provide apparatus and methods for implementing more accurate and reproducible foot impressions and for forming shoe inserts of generally improved composite contours having specific application targeted geometries that are practical for manufacture and thus suitable for sale and distribution to consumers.

SUMMARY OF THE INVENTION

Foot impression generating apparatus comprising buns of open-cell sponge material bonded to and supporting non-porous skins formed of non-blown sponge material is presented in a preferred embodiment of the present invention. The buns and skins are formed from blended mixtures comprising elastomeric thermosetting material (i.e., such as rubber) and low melting temperature thermoplastic material (hereinafter "elastomeric material" and "thermoplastic material" respectively). Optionally, the buns and skins may be formed concomitantly in a known process wherein the bun portion is "blown" within the skin portion.

A pair of mirror-imaged buns and skins are sealingly mounted on bases to form a pair of impression platforms. The air mass instantly contained within the open-cells of each of the buns is substantially contained within their juxtaposed skins other than for selected heating and cooling air-flow paths. When viewed from above, the impression platforms have generally oversize foot-like contours having minimal margins of about an inch all around the largest foot likely to be utilized on or "in" them while making full-length foot impressions (hereinafter "foot impressions"). In use, the mirror-imaged impression platforms are positioned in lateral juxtaposition whereby a consumer such as a shoe store customer or a podiatrist's patient is enabled for concomitantly making full-length foot impressions of both feet.

In greater detail, pairs of impression platforms utilized for any particular consumer are selected from a range of interchangeable impression platforms according to the consumer's weight and foot size. Typically the impression platforms comprise elastomeric material characteristics chosen such that the resulting open-cell sponge material suffers about 50% compression when heated above the melting temperature of the thermoplastic material and loaded with a pressure of about 1.5 lbs./in.$^2$. On the other hand, the thermoplastic material is chosen such that the buns and skins are substantially rigid when cooled below the plastic temperature range of the thermoplastic material.

Generally, the bases have forefoot supporting and trailing portions. Both the forefoot supporting and trailing portions have lofted surfaces where the great toe supporting and arch portions are slightly elevated. The trailing portions can be angularly elevated at selected trailing portion angles ranging from 0 degrees to perhaps 25 degrees with respect to the forefoot supporting portions whenever the buns and skins are in their flexible state (e.g., whenever they are heated above the melting temperature of the thermoplastic material). The transitions between forefoot supporting and trailing portions are meant to coincide with the balls of the feet whereby their locations along the lengths of the foot impressions are in fact utilized as vertical reference planes when digitally recording full-length foot impression contours in the manner described below.

In more minute detail, the lofted forefoot supporting and trailing portions of the bases are chosen in concert with selected contours for the buns and skins. Actual bun and skin contours as well as skin thickness are determined via experimentation and testing. The goal with each impression platform design is to generate ideal foot impressions with anatomically correct arch, outer foot and lessor toe placement for a broad range of foot types.

The forefoot supporting portions of the bases are fixedly positioned on a pivoting platform. The pivoting platform is mounted on a supporting frame structure in a manner similar to a teeter-totter such that the trailing portions of the bases can be located horizontally for ease in stepping into the impression platforms after the buns and skins are in their flexible state.

Initially the pivoting platform is located in a mounting position whereat the trailing portions of the bases are nominally horizontal thus enabling a consumer to readily step into the impression platforms. The supporting frame structure additionally features support rails as an aid for the consumer. Next the pivoting platform is pivoted forward such that the forefoot supporting portions of the bases are located in their nominally horizontal reference positions with the trailing portions elevated—thus enabling the consumer to properly form the foot impressions. When the consumer is comfortable with his or her foot impression position, the buns and skins are cooled below the melting temperature of the thermoplastic material. After the foot impressions are "frozen", the pivoting platform is pivoted back to its initial position thus enabling the consumer to easily dismount.

Foot alignment apparatus is provided in conjunction with each of the trailing portions of the bases whereby the consumer can properly position his or her feet above the trailing portions while the pivoting platform is disposed in its initial mounting position. Thus, when the consumer steps into the heated impression platforms, his or her feet are already aligned in preferred positions with reference to the vertical reference planes as well as means yet to be described for digitally recording the foot impression contours.

The foot alignment apparatus comprises lateral positioning gates juxtaposed to each great toe metatarsal head, and an adjustable form fitting longitudinal gate juxtaposed to the rear of each heel. Preparatory to using the foot impression generating apparatus, the sizes of the consumer's feet are established by known means with reference to the distance between the great toe metatarsal heads and the rear of the heels via utilization of a Brannock device. This establishes the desired distance from the vertical reference planes to the adjustable form fitting longitudinal gates whereby the adjustable form fitting longitudinal gates are physically positioned like distances from the vertical reference planes.

In addition, the adjustable form fitting longitudinal gates are also utilized to record actual lengths of consumer's feet whenever foot impressions are formed at higher valued trailing portion angles. As explained more fully below, this results from concomitant shifting of weight to the forefeet and is important in forming shoe inserts that are representative of a composite blending of at least two sets of foot impressions. In fact, three sets of foot impressions are generally taken by each consumer for this purpose.

In order to effect heating and cooling of the buns and skins, the foot impression generating apparatus also comprises a heating and cooling system. A first preferred heating and cooling system presented herein includes a blower equipped with a heating coil in a manner similar to a hair dryer. Heated and then ambient air is circulated through the open-cell sponge material via inlet vents formed in the forefoot portions of each base and then exhausted through exhaust vents at the rearmost parts of the trailing portions. Heated air temperature is maintained at a selected value slightly above the melting temperature of the thermoplastic material via controlled operation of electrical current flowing through the heating coil. This is accomplished by a temperature controller in response to signals from temperature transducers located in the exhaust vents. The ambient air is obtained by simply turning the temperature controller off. The heating and cooling system is mounted within the supporting frame structure of the foot impression generating apparatus.

A second and somewhat more elaborate preferred heating and cooling system also presented herein includes a damper activated air re-circulation system utilized in conjunction with the blower, heating coil and temperature controller. In this case the heated air is recovered from the exhaust vents and then re-circulated through the blower and heating coil. The temperature of the heated air is still maintained at a selected value slightly above the melting temperature of the thermoplastic material via controlled operation of electrical current flowing through the heating coil. However, the controller only needs to account for net heating losses because the heated air is re-circulated. Thus operation is more efficient and significantly less heat is dumped into the immediate surrounding environment. The damper system of course deactivates the re-circulation system in conjunction with turning the temperature controller off in order to obtain the cooling flow of ambient air.

As already noted above, it has been found experimentally that foot shapes usually change significantly as the trailing portion angle is varied. Perhaps the most noticeable change is a radical reduction in pronation for those so afflicted. In any case, these changes occur because the metatarsal heads and toes support a greater percentage of the consumer's weight as the trailing portion angle is increased. This requires altered and increased flexure of muscles utilized for extending the foot about the ankle joint and for delivering weight supporting force to the metatarsal heads and toes. While the most obvious action is that of forces delivered to the heels by the calf muscles via the Achilles tendons, other supporting muscles arise from the leg bones and deliver force directly to the metatarsal heads via long tendons that bypass the ankle joints. Still other muscles arise from the heel and deliver force to the toes via tendons that bypass the metatarsal heads. All of this results in significant displacement of the heels, increasing prominence of the first metatarsal head, more lateral alignment of the metatarsal heads, and in significant changes in disposition of the metatarsus generally.

In greater detail, it has been found experimentally that as the trailing portion angle increases, the heels and the metatarsal heads are drawn toward one another such that the heels are lowered and move toward the metatarsal heads by as much as 0.150 inch (e.g., the trailing portions of the feet actually shorten). And as a result of this, the arches become more pronounced. This is especially so nearest the heels where the deviation can be as much as 0.250 inch. Lateral alignment of the metatarsal heads varies as well with the first metatarsal heads being lowered and the fifth metatarsal heads becoming elevated because the first through fourth metatarsal heads disproportionately support greater weight than the fifth. This in turn causes the fifth metatarsal bones to become less prominent vertically but move laterally outward.

Another problem is that the forwardly extending portions of the balls of the feet become more prominent as the trailing portion angle is increased. Thus even as the length of the trailing portions of the feet shorten, the curvilinear distances from the vertical reference planes to the toes increase with the result that the overall length of the foot impressions remains about the same. In any case, the toe impressions extend further along the curvilinear path from the vertical reference planes as the trailing portion angle is increased. In addition, toe crest or sulcus filling mounds between the balls of the feet and the toes present in the foot impressions become better defined and differently placed.

In general, the problem then is to somehow utilize the foot impression generating apparatus for generating composite foot impressions useful for forming shoe inserts that will acceptably support the feet during activities ranging from sedentary to walking or even running. This must be done despite the obvious fact that perfectly formed shoe inserts for ideally supporting the feet during each activity and during each segment of each dynamically varying activity differ significantly.

Trailing portion angles are chosen in accordance with the intended dynamic range of any particular pair of shoe inserts. As mentioned above, at least two and preferably three sets of foot impressions are taken before forming any pair of shoe inserts. In general, rearmost regions of the shoe inserts should be representative of foot impressions taken at a 0 degree training portion angle, more forward regions thereof should be representative of a graduated blending to and of foot impressions taken at 12.5 and 25 degree trailing portion angles, and forefoot regions totally representative of the foot impressions taken at a 25 degree trailing portion angle. However, shoe inserts intended for athletic use such as in a pair of track shoes would blend more quickly toward mimicking foot impressions taken higher valued trailing portion angles than those intended for use in more sedentary activities.

In any case, each set of foot impressions is scanned by non-contacting scanning means. Then digital "point cloud data" therefrom is processed in a manner whereby digitized foot impression contour maps (hereinafter "digitized foot impressions") are formed. Suitable non-contacting scanning means for creating digital "point cloud data" that is representative of the foot impressions is available from Steinbichier Optotechnik GmbH of Neubeuern, Germany. Suitable software for forming and manipulating polygonal master model or other surface descriptive digital files (hereinafter "polygonal master model files" for convenience) from the point cloud data and thereby forming digitized foot impressions is available from InnovMetric Software Inc. of Sainte-Foy, Quebec, Canada under the trade name "PolyWorks/Modeler", and/or Gibbs and Associates of Moorpark, Calif. under the trade names "Virtual Gibbs" and "GibbsCam".

Next, features of the at least two and preferably three sets of digitized foot impressions are combined into a composite set of digitized foot impressions such that shoe inserts resulting therefrom support the feet in an acceptable manner. For instance, in the case of a runner it is first necessary to properly support his or her feet when they are load supporting in a planar manner prior to "toeing off". Then under dramatically different conditions it is also necessary to properly support the balls and toes of the runner's feet when they become load bearing during "toeing off" with the trailing portion of his or her foot disposed at a significant trailing portion angle. Thus, the set of digitized foot impressions made with a lessor trailing portion angle is used predominantly for the rear and outer portions of the composite set of digitized foot impressions while the set of digitized foot impressions made with a greater trailing portion angle is used predominantly for the front and inner portions of the composite set of digitized foot impressions.

Two predominant feature changes occur as the trailing portion angle increases. Firstly, there is a dramatic reduction in pronation. This is implemented in the form of an inward rotation of the metatarsus. By way of example, a line more-or-less parallel to the present inventor's metatarsal heads nominally varies from 8 degrees to 2 degrees to −2 degrees of pronation as the trailing portion angle is changed from 0 degrees to 12.5 degrees to 25 degrees. However, there is little or no corresponding roll direction rotation of the heel.

The second and complicating feature change is that the heels move downward and forward at greater trailing portion angles thus foreshortening the rearmost portion of the trailing portions of the foot impressions. This is accounted for by compressionally distorting the digitized foot impression data along the X-axis over the rear portion of the distance from the vertical reference planes to the heels. Thus, differences in the distances measured from the vertical reference planes to the adjustable form fitting longitudinal gates are accounted for only over those compressionally distorted distances.

In greater detail, mean average angularly located lines are established in generally forward directions from inside to outside of the composite set of digitized foot impressions. For instance, mean average angularly located lines might pass through the X-axis roughly at the 40% and 60% positions and then respectively extend more-or-less through the fifth metatarsal heads and the fifth metatarsals. In any case, transition zones are established on either side of the mean average lines such that positions of the rear of the fifth metatarsals are representative of the lessor trailing portion angle derived digitized foot impressions; positions of the first metatarsal heads are completely representative of the greater trailing portion angle derived digitized foot impressions; and positions of the fifth metatarsal heads are more-or-less representative of average values therebetween.

The result is that shoe inserts made from the composite digitized foot impressions support the heel, arch and outer portions of the feet generally with their proper pronation while they are in contact with the ground. Otherwise those areas will feel constrained and resulting muscle strain is likely to appear in the inner ankle areas and in outer quad areas of the legs (e.g., above the knees). At the same time, the metatarsus is properly supported prior to "toe off" and the balls of the feet and toes are properly supported during "toe off". Otherwise metatarsal strain is likely and proper "toe off" will be impeded.

While the feet are disposed in a planar weight-supporting manner, the arch areas are somewhat over-supported and the balls of the feet are located a little too far forward because the heels are constrained by heel counters in the shoes. These faults seem to be adequately tolerated however. Specifically in the case of the balls of the feet being located too far forward, there is adequate room for them because the shoe inserts are formed with generous concave "pockets" as a result of the curvilinear distance from the vertical reference planes to the toes having been increased during the formation of the foot impressions made at the greater trailing portion angles. When "toeing off", the balls of the feet then actually slide rearward into their "nested positions" with the heels remaining in a fixed location with respect to the heel counters and heel portions of the shoe inserts.

A method of creating digitized foot impressions representative of the bottom foot contours of a consumer's feet is presented in a first alternate preferred embodiment of the present invention. First, the lengths of the consumer's feet are measured with a Brannock device. Then the foot alignment apparatus is set according to those measurements. Next the impression platforms are heated slightly above the melting temperature of the thermoplastic material whereby the impression platforms adopt elastomeric properties as determined by the constituent elastomeric material. Then the trailing portions of the bases are positioned at a selected trailing portion angle wherefrom either of the bases can be further elevated by a selected supplemental elevation angle to compensate for the consumer having one leg shorter than the other. The pivoting platform is then negatively positioned at the inverse of the selected trailing portion angle (e.g., for non-zero valued trailing portion angles) such that the trailing portions of non-further elevated bases are horizontal.

Next (e.g., with the impression platforms maintained at their proper impression platform temperature), the consumer aligns his or her feet with reference to the foot alignment apparatus. Then he or she steps into the impression platforms thereby deforming the buns and skins in an elastomeric manner. Then (e.g., again for non-zero valued trailing portion angles) the pivoting platform is forwardly rotated to its reference position whereat a portion of the consumer's weight is supported by his or her toes over the horizontally disposed forefoot supporting portions of the bases in dependence upon the trailing portion angle. Then the lengths of the consumer's feet are again checked with the adjustable form fitting longitudinal gates of the foot alignment apparatus.

Next, the impression platforms are rapidly cooled to a temperature below that of the low temperature end of the plastic range of the thermoplastic material. This serves to "freeze" the buns and skins of both impression platforms in their deformed positions. After the buns and skins are frozen, the pivoting platform is returned to its negatively positioned location whereat the trailing portions of non-further elevated bases are again horizontal. Then the consumer removes his or her weight and feet from the impression platforms leaving a finished pair of foot impressions impressed therein. Finally, the contours of the foot impressions are scanned in order to form point cloud data representative of the foot impressions. The point cloud data is converted to a polygonal master model file and stored as a first set of digitized foot impressions.

The above procedure is repeated utilizing the remaining selected trailing portion angles thus creating sequentially stored sets of digitized foot impressions. Finally a composite set of digitized foot impressions is formed from the stored digitized foot impressions and stored in a consumer's file. The consumer's file also includes his or her shoe type and size. It also includes a supplemental elevation angle utilized for either foot impression in the event that one of the consumer's legs is shorter than the other.

Because the consumer's information is stored in the consumer's file, there is no requirement for shoe insert generating apparatus (i.e., a digitally controlled milling machine and controls therefor) to be proximate to the foot impression generating apparatus. In fact, the shoe insert generating apparatus can be located anywhere. It can of course be proximate to the foot impression generating apparatus whereby finished shoe inserts can be directly presented to the consumer. At the opposite extreme, the file can be e-mailed to a remote shoe insert fabrication center where the shoe inserts are formed and then shipped to the consumer.

In detail then, a preferred method of creating digitized foot impressions representative of the bottom foot contours of a consumer's feet at a selected foot impression forming position via utilization of a foot impression generating apparatus comprising foot alignment apparatus and impression platforms including buns of blown open-cell sponge material bonded to and supporting non-porous skins formed of non-blown sponge material wherein the buns and skins are mounted upon a pair of bases having forefoot supporting and angularly elevatable trailing portions longitudinally separated by vertical reference planes with the forefoot supporting portions being in turn supported upon a pivoting platform comprises the steps of: measuring the lengths of the consumer's feet; setting the foot alignment apparatus in a matching manner; heating the impression platforms slightly above the melting temperature of the thermoplastic material; angularly elevating the trailing portions to a selected angular elevation angle representative of the selected foot impression forming position; positioning the pivoting platform to an initial position whereat the trailing portions are horizontal; further angularly elevating either trailing portion at an appropriate supplemental elevation angle in order to compensate for a short leg in the event that the consumer has one leg shorter that the other; the consumer aligning his or her feet with reference to the foot alignment apparatus; the consumer stepping into the impression platforms thereby deforming the buns and skins in an elastomeric manner; forwardly rotating the pivoting platform to the selected foot impression forming position whereat the consumer forms foot impressions in conformance with the shape of his or her feet at the selected foot impression forming position; re-measuring the length of the consumer's feet with the foot alignment apparatus; cooling the impression platforms to a temperature below that of the low temperature end of the plastic range of the thermoplastic material; rotating the pivoting platform back to its initial position; the consumer removing his or her weight and feet from the impression platforms; scanning the contours of the foot impressions; creating digital data representative of the contours of the foot impressions as formed at the selected foot impression forming position; and storing the digital data as digitized foot impressions along with the re-measured lengths of the consumer's feet as a set of data representative of the contours of the consumer's foot impressions as taken at the selected foot impression forming position.

In addition, a preferred method of creating a composite set of digitized foot impressions representative of a selected blending of at least two sets of data representative of the contours of a consumer's foot impressions, where each of the at least two sets of data have previously been determined at selected foot impression forming positions according to the preferred method of creating digitized foot impressions, wherein the method comprises the steps of: compressionally distorting the digitized foot impression or impressions data comprised in the set or sets of data representative of the contours of a consumer's foot impressions taken at the lessor trailing portion angle or angles over the rear portion of the distance from the great toe metatarsal heads to the rear of the heels such that the resulting distance between the great toe metatarsal heads and the rear of the heels comprised in the set or sets of the so modified digitized foot impression data is or are equal to that of the set of data representative of the contours of the consumer's foot impressions taken at the greater trailing portion angle; positioning the sets of so modified digitized foot impression data progressively along the longitudinal axis of the composite set of digitized foot impressions with the digitized data from the set of data representative of the contours of the consumer's foot impressions taken at the largest trailing portion angle positioned forwardly and those taken at the smallest trailing portion angle rearwardly with the respective sets of digitized data generally disposed to either side of a mean average angularly skewed line or lines extending from inside to outside of the composite set of digitized foot impressions in a generally forward direction or directions; and establishing transition zones on either side of the mean average line or lines such that there is a smooth transition between digitized data from the set of data representative of the contours of the consumer's foot impressions taken at the largest trailing portion angle generally present from the forward portion of the instep through the forefoot supporting regions to digitized data from the set of data representative of the contours of the consumer's foot impressions taken at the smallest trailing portion angle generally present from the rear of the fifth metatarsal through the heel regions, with the fully implemented composite set of digitized foot impressions along with the consumer's identification, shoe type and size, and any supplemental elevation angle utilized in a personal file ready for use in shoe insert generating apparatus.

It is known to utilize hemispherical cutters for shaping shoe inserts from shoe insert blanks. In order to accurately generate shoe insert contours from the composite set of digitized foot impressions via utilization of such hemispherical cutters it is of course necessary to provide tool radius compensation for the hemispherical cutters whereby digital control information fed to the Z-axis position control is selectively modified.

Herein however, should a polygonal master model file comprise a surface contour section with a concave curved segment having a smaller radius than the hemispherical cutter radius, it clearly would not be possible to generate tool radius compensation offset corrections for that concave curved segment for such a hemispherical cutter. The next problem to be solved then relates to the fact that concave curved segments with radii smaller than those of normally utilized hemispherical cutters (i.e., 0.500 inch) often occur near the outer edges of laterally oriented surface contour sections.

Two methods of solving this anomaly are presented herein in first and second methods of forming shoe inserts respectively presented in second and third alternate preferred embodiments of the present invention. In both cases, the shoe inserts are formed from insert blanks made from a material, such as ethyl vinyl acetate (EVA), that is somewhat pliable in order to accommodate flexure of the forefoot regions as a consumer toes off during normal walking or running activities. Both methods of forming shoe inserts are executed in shoe insert generating apparatus comprising a digitally controlled milling machine. In either case, the milling spindle of the digitally controlled milling machine is laterally rotated and utilizes a dovetail cutter for cutting the surface contour of the shoe inserts in laterally directed passes. The milling spindle is rotated by perhaps 60 degrees while the dovetail cutter has an apex angle of perhaps 60 degrees with the apex radius thereof configured with a relatively small radius of perhaps 0.100 inch. This makes it possible to eliminate laterally directed tool radius compensation offset correction in the trailing portions of the shoe inserts. This is because the cutting error would then be limited to an acceptable 0.013-inch for a 30-degree lateral slope.

In the first method of forming shoe inserts, a relatively small dovetail cutter having a radius such as 0.400 inch is utilized. This makes it possible to eliminate tool radius compensation offset correction in the longitudinal direction as well. This is because the cutting error would again be limited to an acceptable 0.013-inch for a 15-degree longitudinal slope.

On the other hand, there is no such limitation on dovetail cutter radius in the second method of forming shoe inserts because longitudinally directed tool radius compensation offset correction is still implemented. The result is that trailing portion slopes are cut without error in the longitudinal direction.

In general, digitized foot impressions define toe crests or sulcus filling mounds between the balls of the feet and the toes. However, virtually all consumers would find complete toe crests or sulcus filling mounds to be excessively confining if they were precisely reproduced in their shoe inserts.

Herein in the first method of forming shoe inserts, this problem is automatically handled because the front surfaces of concave cavities for accommodating the balls of the feet that are formed in the shoe inserts are disposed at a significant angle with the X-axis. Thus they are cut deeper than the virtual front surfaces comprised in the digitized foot impressions which reduces toe crests or sulcus filling mounds as desired.

In the second method of forming shoe inserts this problem is handled by selectively modifying the longitudinally directed tool radius compensation offset correction in the forefoot regions. In essence the assumed tool radius is selectively reduced. Thus the front surfaces of concave cavities formed in the shoe inserts for accommodating the balls of the feet are again cut deeper than the virtual front surfaces comprised in the digitized foot impressions which again reduces toe crests or sulcus filling mounds as desired.

Additionally in the second method of forming shoe inserts, it is possible to utilize a fictitious negative tool radius compensation offset correction in the lateral direction forward of the vertical reference planes. This results in any laterally oriented slopes forward of the vertical reference planes being cut more deeply as well. The resulting lateral freedom provides for some lateral movement of the toes.

In either method however, the first step in actually fabricating a pair of shoe inserts from a composite set of digitized foot impressions involves positioning the composite set of digitized foot impressions in virtual space with respect to shoe insert blank supporting devices mounted on the table of the digitally controlled milling machine (hereinafter "table"). The shoe insert blank supporting devices are then used for holding precut or pre-molded shoe insert blanks from which the shoe inserts are formed. Generally, the composite set of digitized foot impressions will be properly positioned in the roll, yaw, X and Y directions as a result of consistency between the original placement of the feet on the impression platforms via the alignment apparatus and the shoe insert blank placement on the shoe insert blank supporting devices via similar alignment apparatus. However, the composite set of digitized foot impressions needs to be positioned in the pitch and Z directions with respect to the table such that minimum clearance values of perhaps 0.150 inch are maintained between the composite set of digitized foot impressions and the shoe insert blank supporting devices.

An exception would of course be in accommodating a short leg by maintaining the supplemental elevation angle for that composite digitized foot impression as specified in the consumer's personal file. This would provide a greater clearance distance from the shoe insert blank supporting device for that composite digitized foot impression, and would of course result in a thicker trailing portion of that shoe insert.

In addition, the actual angle that the forward portions of the composite digitized foot impressions then make with reference to the table must be accommodated through selection of a set of shoe insert blank supporting devices (i.e., implemented herein as a set of vacuum chucks) having appropriate upward slopes in their forward portions. In general, both the shoe insert blank supporting devices and precut or pre-molded shoe insert blanks are formed with upwardly sloped portions forward of the vertical reference planes and with suitable blend radii between their forefoot supporting and trailing portions. In any case, a particular set of shoe insert blank supporting devices is selected based upon maintenance of the minimum clearance between them and the composite digitized foot impressions and then mounted on the table.

An appropriate pair of shoe insert blanks is positioned and held in the shoe insert blank supporting devices with reference to an alignment apparatus similar to that described above for locating the consumer's feet with reference to the impression platforms. Next the desired shoe insert contours are cut into the pair of shoe insert blanks in conformance with the composite set of digitized foot impressions and the respective procedures described above for cutting the trailing and forefoot portions. In addition, the forward most portions of the shoe insert contours (e.g., forward of the lowest points of the toes) are cut parallel to the upwardly sloped portions of the shoe insert blank supporting devices.

However, it is important to realize that the goal behind forming the shoe inserts is to fill the volumetric space between contours representative of the consumer's composite digitized foot impressions and the actual geometry of the insert mounting surfaces in his or her shoes. Thus, in either method of forming shoe inserts the polygonal master model files used for forming a pair of shoe insert contours should be corrected for accommodating non-flat insert mounting surfaces. Seemingly this correction is never applied in present practice. It is quite important however because otherwise the somewhat pliable material used for the shoe inserts will conform to such non-flat insert mounting surfaces and thus deleteriously modify the foot supporting contours of the shoe inserts.

Although it would be ideal if all shoe manufacturers made shoes from shoe lasts having flat reference surfaces in their trailing portions and cylindrically curving forefoot supporting portions, and/or were at least consistent in their last proportions, in the real world they most certainly do not. Generally, shoe lasts are formed with a relatively sharp concave bend under the rear of the instep in conjunction with an otherwise generally convex shape in an attempt to accommodate "average" feet in shoes made therefrom. Proportions of the instep and heel areas vary widely even within identical width designations.

Thus, it is necessary to obtain typical shoe last bottom geometry utilized for a representative shoe size for each shoe type utilized. This information is stored in polygonal master model files and then scaled over various shoe sizes and widths when processing pairs of shoe inserts for different consumers having a range of foot sizes. The scaled information is incorporated into each personal file by subtracting so generated shoe reference surface polygonal model files from the polygonal master model files comprised within the composite set of digitized foot impressions. As a consequence of this, an individual pair of shoe inserts should ideally be utilized in each type of shoe a consumer wears. In any case, the shoe insert contours are in fact formed in the digitally controlled milling machine in conformance with the data indicative of the consumer's composite set of digitized foot impressions less the scaled corrections of the selected one of the typical shoe last bottom geometries.

While it is certainly possible to inventory an enormous selection of shoe insert blanks and the very wide assortment of shoe insert blank supporting devices necessary for holding them on the table, or alternately to hand form the edge contours of the resulting shoe inserts to fit individual shoes, it is believed preferable herein to utilize a minimal number of oversize shoe insert bank sizes and then form the edge contours of the shoe inserts with a router head and cutter also mounted on the digitally controlled milling machine. This requires a gimbal mounted router head mounted in juxtaposition with the digitally controlled milling machine's milling spindle. Thus in conjunction with the X, Y and Z axes, the gimbal mounted router head concomitantly enables the digitally controlled milling machine to be operated as a 5-axis router.

A dovetail cutter comprising a sharp apex is used for cutting the edge contours of the shoe inserts. The dovetail cutter is configured with a dovetail cutter angle greater than any anticipated instep contour angle. This results in the gimbal-mounted router head of the 5-axis router always being angled inward as the dovetail cutter cuts the edge contours of the shoe insert blanks. The 5-axis router is programmed such that the apex of the dovetail cutter just misses the shoe insert blank supporting device and leaves a slight amount of "flash" surrounding the bottom surface of the shoe inserts. After the edge contours of the shoe inserts are formed in this manner, the shoe inserts are removed from the shoe insert blank supporting devices and the flash is removed by hand methods. Then the contoured top surfaces of the shoe inserts are covered with material suitable for interfacing with the feet. Finally, the finished pair of shoe inserts is presented or shipped to the consumer.

In detail then, a preferred method of forming shoe inserts for a consumer in a digitally controlled milling machine equipped with a laterally rotated milling spindle and a dovetail cutter having an apex radius smaller than any anticipated shoe insert feature radius along with a gimbal mounted router head with a dovetail cutter having a dovetail cutter angle greater than any anticipated instep contour angle, and having a software library of typical shoe last bottom geometries and typical shoe insert edge contours, wherein the method comprises the steps of: providing data indicative of the contours of the consumer's composite set of digitized foot impressions, shoe type and size, and any other details unique to the consumer such as a supplemental elevation angle for accommodating a shorter leg; subtracting scaled corrections of a selected one of the typical shoe last bottom geometries stored in the library from the composite digitized foot impressions; positioning the composite digitized foot impressions with reference to the table of the digitally controlled milling machine; selecting an appropriately sized pair of shoe insert blanks; selecting an appropriate set of shoe insert blank supporting devices for holding the shoe insert blanks as required for maintaining proper minimum clearance values in the forefoot portions of the composite digitized foot impressions; forming the shoe insert contours in the digitally controlled milling machine with the milling spindle in conformance with the composite digitized foot impressions less scaled corrections of the selected one of the typical shoe last bottom geometries; cutting edge contours of the shoe inserts with the gimbal mounted router head in conformance with scaled versions of the stored shoe insert edge contours in a manner such that the apex circumference of the dovetail cutter just misses the shoe insert blank supporting devices leaving a slight amount of "flash" surrounding the bottom surface of the shoe inserts; removing the shoe inserts from the shoe insert blank supporting devices; removing the flash; covering the shoe inserts with material suitable for interfacing with the feet; and presenting or shipping the finished shoe inserts to the consumer.

Optionally, an alternate preferred method of forming shoe inserts for a consumer in a digitally controlled milling machine equipped with a laterally rotated milling spindle and a dovetail cutter having an apex radius smaller than any anticipated shoe insert feature radius along with a gimbal mounted router head with a dovetail cutter having a dovetail cutter angle greater than any anticipated instep contour angle, and having a software library of typical shoe last bottom geometries and typical shoe insert edge contours, wherein the method comprises the steps of: providing data indicative of the contours of the consumer's composite set of digitized foot impressions, shoe type and size, and any other details unique to the consumer such as a supplemental elevation angle for accommodating a shorter leg; subtracting scaled corrections of a selected one of the typical shoe last bottom geometries stored in the library from the composite digitized foot impressions; positioning trailing portions of the composite digitized foot impressions with reference to the table of the digitally controlled milling machine; selecting an appropriately sized pair of shoe insert blanks; selecting an appropriate set of shoe insert blank supporting devices for holding the shoe insert blanks as required for maintaining proper minimum clearance values in the forefoot portions of the composite digitized foot impressions; entering tool radius compensation offset correction values to be used in the trailing portions of the shoe insert contours, and reduced tool radius and fictitious tool radius compensation offset correction values to be used in the forefoot supporting portions of the shoe insert contours into the digitally controlled milling machine; forming the shoe insert contours in the digitally controlled milling machine with the milling spindle in conformance with the composite digitized foot impressions less scaled corrections of the selected one of the typical shoe last bottom geometries; cutting edge contours of the shoe inserts with the gimbal mounted router head in conformance with scaled versions of the stored shoe insert edge contours in a manner such that the apex circumference of the dovetail cutter just misses the shoe insert blank supporting devices leaving a slight amount of "flash" surrounding the bottom surface of the shoe inserts; removing the shoe inserts from the shoe insert blank supporting devices; removing the flash; covering the shoe inserts with material suitable for interfacing with the feet; and presenting or shipping the finished shoe inserts to the consumer.

Thus in a first aspect, the present invention is directed to a foot impression generating apparatus for enabling formation of foot impressions, comprising: impression platforms including buns of blown open-cell sponge material bonded to and supporting non-porous skins formed of non-blown sponge material wherein the sponge material comprises elastomeric and thermoplastic materials, and wherein the buns and skins are mounted upon a pair of bases having forefoot supporting and angularly elevatable trailing portions; and heating and cooling means for heating the impression platforms to a temperature slightly above the melting temperature of the thermoplastic material and then cooling the impression platforms to a temperature below that of the low temperature end of the plastic range of the thermoplastic material.

In a second aspect, the present invention is directed to the foot impression generating apparatus of the first aspect wherein the heating and cooling means comprises: a blower equipped with a heating coil similarly to a hair dryer for providing heated and then ambient air to the impression platforms; inlet and exhaust vents for circulating the heated and then ambient air through the open-cell sponge material; a temperature transducer for providing a signal indicative of the temperature of the heated air; and a temperature controller for maintaining the heated air at a selected temperature slightly above the melting temperature of the thermoplastic material in response to the signal from the temperature controller, wherein a flow of the heated air is provided via turning the blower on and controlling a electrical current flowing through the heating coil, and then a flow of cooling ambient air is provided by turning the electrical current off.

In a third aspect, the present invention is directed to the foot impression generating apparatus of the second aspect additionally comprising a damper activated air re-circulation system for recovering heated air and re-circulating it through the open-cell sponge material.

In a fourth aspect, the present invention is directed to the foot impression generating apparatus of the first aspect additionally comprising foot alignment means having lateral positioning gates laterally juxtaposed to selected foot impression positions for a consumer's great toe metatarsal heads, and adjustable form fitting longitudinal gates juxtaposed to selected foot impression positions for the rear of the consumer's heels.

In a fifth aspect, the present invention is directed to a method of creating foot impressions representative of the bottom foot contours of a consumer's feet at a selected foot impression forming position via utilization of foot impression generating apparatus configured in accordance with the first aspect wherein the method comprises the steps of: heating the impression platforms slightly above the melting temperature of the thermoplastic material; angularly elevating the trailing portions to a selected angular elevation angle representative of the selected foot impression forming position; the consumer stepping into the impression platforms thereby deforming the buns and skins in an elastomeric manner and thus forming foot impressions in conformance with the shape of his or her feet at the selected foot impression forming position; cooling the impression platforms to a temperature below that of the low temperature end of the plastic range of the thermoplastic material; and the consumer removing his or her weight and feet from the impression platforms thus leaving the consumer's foot impressions as taken at the selected foot impression forming position.

In a sixth aspect, the present invention is directed to the foot impression generating apparatus of the fourth aspect additionally comprising non-contacting scanning means for creating digital "point cloud data" representative of the foot impressions.

In a seventh aspect, the present invention is directed to a method of creating digitized foot impressions representative of the bottom foot contours of a consumer's feet at a selected foot impression forming position via utilization of foot impression generating apparatus configured in accordance with the sixth aspect wherein the method comprises the steps of: measuring the distances between the great toe metatarsal heads and the rear of the heels of the consumer's feet; setting the foot alignment apparatus in a matching manner; heating the impression platforms slightly above the melting temperature of the thermoplastic material; angularly elevating the trailing portions to a selected angular elevation angle representative of the selected foot impression forming position; positioning the pivoting platform to an initial position whereat the trailing portions are horizontal; further angularly elevating either trailing portion at an appropriate supplemental elevation angle in order to compensate for a short leg in the event that the consumer has one leg shorter that the other; the consumer aligning his or her feet with reference to the foot alignment apparatus; the consumer stepping into the impression platforms thereby deforming the buns and skins in an elastomeric manner; forwardly rotating the pivoting platform to the selected foot impression forming position whereat the consumer forms foot impressions in conformance with the shape of his or her feet at the selected foot impression forming position; re-measuring the distances between the great toe metatarsal heads and the rear of the heels of the consumer's feet with the foot alignment apparatus; cooling the impression platforms to a temperature below that of the low temperature end of the plastic range of the thermoplastic material; rotating the pivoting platform back to its initial position; the consumer removing his or her weight and feet from the impression platforms; scanning the contours of the foot impressions; creating digital data representative of the contours of the foot impressions as formed at the selected foot impression forming position; and storing the digital data as digitized foot impressions along with the re-measured distances between the great toe metatarsal heads and the rear of the heels of the consumer's feet as a set of data representative of the contours of the consumer's foot impressions as taken at the selected foot impression forming position.

In an eighth aspect, the present invention is directed to a method of creating a composite set of digitized foot impressions representative of a selected blending of at least two sets of data representative of the contours of a consumer's foot impressions, where each of the at least two sets of data have previously been determined at selected foot impression forming positions according to the method of the seventh aspect, wherein the method comprises the steps of: compressionally distorting the digitized foot impression or impressions data comprised in the set or sets of data representative of the contours of a consumer's foot impressions taken at the lessor trailing portion angle or angles over the rear portion of the distance from the great toe metatarsal heads to the rear of the heels such that the resulting distance between the great toe metatarsal heads and the rear of the heels comprised in the set or sets of the so modified digitized foot impression data is or are equal to that of the set of data representative of the contours of the consumer's foot impressions taken at the greater trailing portion angle; positioning the sets of so modified digitized foot impression data progressively along the longitudinal axis of the composite set of digitized foot impressions with the digitized data from the set of data representative of the contours of the consumer's foot impressions taken at the largest trailing portion angle positioned forwardly and those taken at the smallest trailing portion angle rearwardly with the respective sets of digitized data generally disposed to either side of a mean average angularly skewed line or lines extending from inside to outside of the composite set of digitized foot impressions in a generally forward direction or directions; and establishing transition zones on either side of the mean average line or lines such that there is a smooth transition between digitized data from the set of data representative of the contours of the consumer's foot impressions taken at the largest trailing portion angle generally present from the forward portion of the instep through the forefoot supporting regions to digitized data from the set of data representative of the contours of the consumer's foot impressions taken at the smallest trailing portion angle generally present from the rear of the fifth metatarsal through the heel regions, with the fully implemented composite set of digitized foot impressions along with the consumer's identification, shoe type and size, and any supplemental elevation angle utilized in a personal file ready for use in shoe insert generating apparatus.

In a ninth aspect, the present invention is directed to a method of forming shoe inserts for a consumer via utilization of a digitally controlled milling machine equipped with a laterally rotated milling spindle and a dovetail cutter having an apex radius smaller than any anticipated shoe insert feature radius, and having a software library of typical shoe last bottom geometries, wherein the method comprises the steps of: providing data indicative of the contours of the consumer's composite set of digitized foot impressions, shoe type and size, and any other details unique to the consumer such as a supplemental elevation angle for accommodating a shorter leg; subtracting scaled corrections of a selected one of the typical shoe last bottom geometries stored in the library from the composite digitized foot impressions; positioning the composite digitized foot impressions with reference to the table of the digitally controlled milling machine; selecting an appropriately sized pair of shoe insert blanks; selecting an appropriate set of shoe insert blank supporting devices for holding the shoe insert blanks as required for maintaining proper minimum clearance values in the forefoot portions of the composite digitized foot impressions; forming the shoe insert contours in the digitally controlled milling machine with the milling spindle in conformance with the composite digitized foot impressions less scaled corrections of the selected one of the typical shoe last bottom geometries; removing the shoe inserts from the shoe insert blank supporting devices; covering the shoe inserts with material suitable for interfacing with the feet; and presenting or shipping the finished shoe inserts to the consumer.

In a tenth aspect, the present invention is directed to the method of the ninth aspect wherein the digitally controlled milling machine is additionally equipped with a gimbal mounted router head with a dovetail cutter having a dovetail cutter angle greater than any anticipated instep contour angle and the library additionally comprises typical shoe insert edge contours, wherein the method additionally includes the steps of: cutting edge contours of the shoe inserts with the gimbal mounted router head in conformance with scaled versions of the stored shoe insert edge contours in a manner such that the apex circumference of the dovetail cutter just misses the shoe insert blank supporting devices leaving a slight amount of "flash" surrounding the bottom surface of the shoe inserts; and removing the flash before presenting or shipping the finished shoe inserts to the consumer.

In an eleventh aspect, the present invention is directed to an alternate preferred method of forming shoe inserts for a consumer via utilization of a digitally controlled milling machine equipped with a laterally rotated milling spindle and a dovetail cutter having an apex radius smaller than any anticipated shoe insert feature radius, and having a software library of typical shoe last bottom geometries, wherein the method comprises the steps of: providing data indicative of the contours of the consumer's composite set of digitized foot impressions, shoe type and size, and any other details unique to the consumer such as a supplemental elevation angle for accommodating a shorter leg; subtracting scaled corrections of a selected one of the typical shoe last bottom geometries stored in the library from the composite digitized foot impressions; positioning trailing portions of the composite digitized foot impressions with reference to the table of the digitally controlled milling machine; selecting an appropriately sized pair of shoe insert blanks; selecting an appropriate set of shoe insert blank supporting devices for holding the shoe insert blanks as required for maintaining proper minimum clearance values in the forefoot portions of the composite digitized foot impressions; entering tool radius compensation offset correction values to be used in forming the trailing portions of the shoe insert contours, and reduced tool radius and fictitious tool radius compensation offset correction values to be used in forming the forefoot supporting portions of the shoe insert contours into the digitally controlled milling machine; forming the shoe insert contours in the digitally controlled milling machine with the milling spindle in conformance with the composite digitized foot impressions less scaled corrections of the selected one of the typical shoe last bottom geometries; removing the shoe inserts from the shoe insert blank supporting devices; covering the shoe inserts with material suitable for interfacing with the feet; and presenting or shipping the finished shoe inserts to the consumer.

In a twelfth aspect, the present invention is directed to the method of the eleventh aspect wherein the digitally controlled milling machine is additionally equipped with a gimbal mounted router head with a dovetail cutter having a dovetail cutter angle greater than any anticipated instep contour angle and the library additionally comprises typical shoe insert edge contours, wherein the method additionally includes the steps of: cutting edge contours of the shoe inserts with the gimbal mounted router head in conformance with scaled versions of the stored shoe insert edge contours in a manner such that the apex circumference of the dovetail cutter just misses the shoe insert blank supporting devices leaving a slight amount of "flash" surrounding the bottom surface of the shoe inserts; and removing the flash before presenting or shipping the finished shoe inserts to the consumer.

BRIEF DESCRIPTION OF THE DRAWING

A better understanding of the present invention will now be had with reference to the accompanying drawing, wherein like reference characters refer to like parts throughout the several views herein, and in which:

FIG. 10 is a flow chart depicting a preferred method of creating a composite set of digitized foot impressions representative of a selected blending of digitized foot impressions;

DETAILED DESCRIPTION OF THE PREFERRED EMBODIMENT

Figure 1:
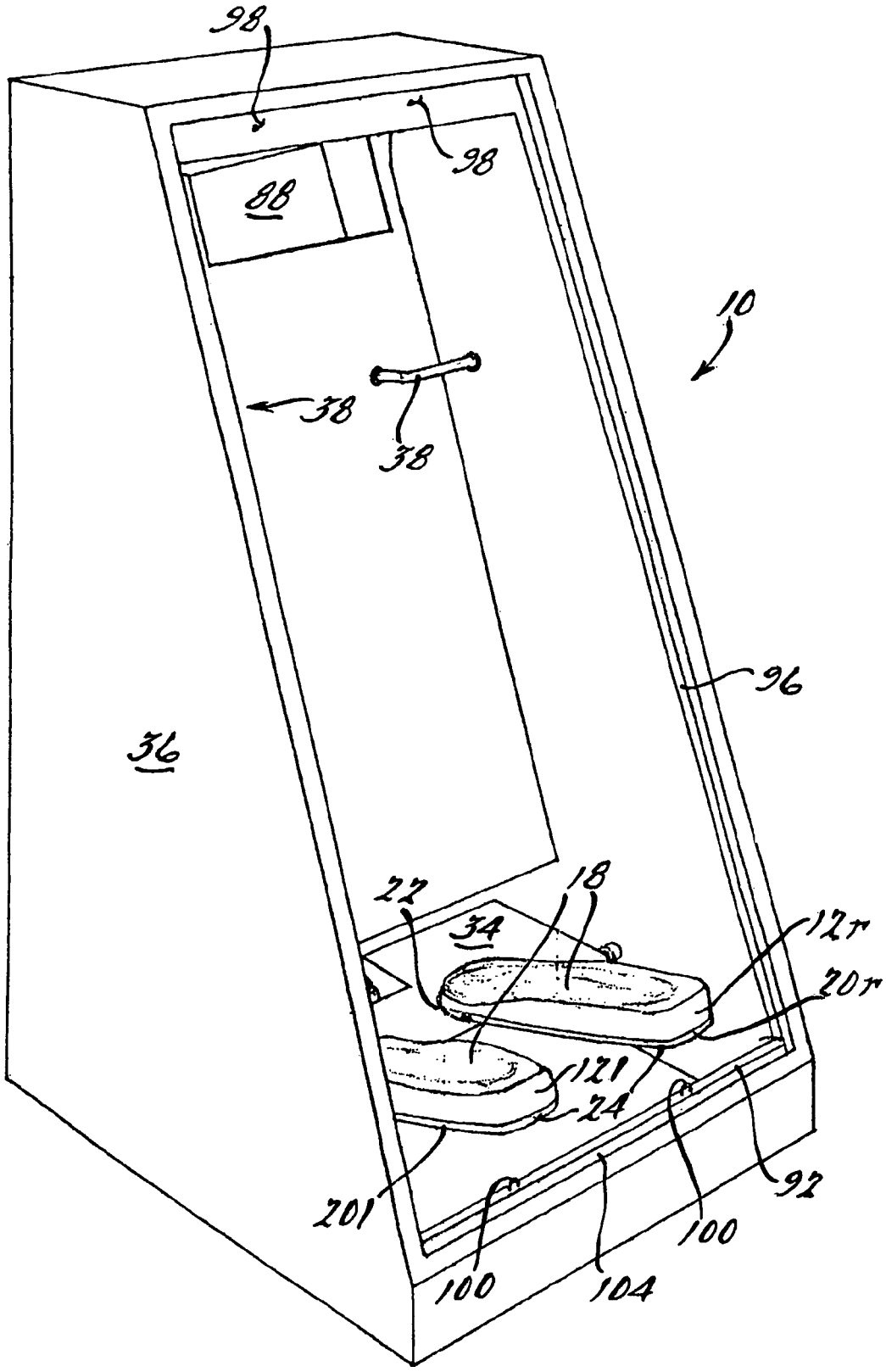
FIG. 1 is a perspective view of a foot impression generating apparatus.

With reference now to FIG. 1, there shown is a perspective view of foot impression generating apparatus 10 according to a preferred embodiment of the present invention. As shown in greater detail in FIG. 2, the foot impression generating apparatus 10 comprises impression platforms 12*l* and 12*r* including buns 14 of open-cell sponge material bonded to and supporting non-porous skins 16 formed of non-blown sponge material. The buns 14 and skins 16 are formed from blended mixtures comprising elastomeric thermosetting material (hereinafter "elastomeric material") (e.g., such as rubber) and low melting temperature thermoplastic material (hereinafter "thermoplastic material"), and may in fact be formed concomitantly in a known process wherein the bun 14 is "blown" within the skin 16.

When viewed from above, the impression platforms 12*l* and 12*r* have generally oversize foot-like contours having minimal margins of about an inch all around the largest foot likely to utilize them while making full-length foot impressions 18 (hereinafter "foot impressions 18"). In use, a mirror-imaged pair of such impression platforms 12*l* and 12*r* is positioned in lateral juxtaposition whereby a consumer such as a shoe store customer or a podiatrist's patient is enabled for concomitantly making full-length foot impressions of both feet.

In greater detail, pairs of impression platforms 12*l* and 12*r* utilized for any particular consumer are selected from a range of interchangeable impression platforms 12*l* and 12*r* according to the consumer's weight and foot size. A midrange impression platform 12*l* or 12*r* comprises elastomeric material and open-cell characteristics chosen such that the resulting open-cell sponge material suffers about 50% compression when heated above the melting temperature of the thermoplastic material and loaded with a pressure of about 1.5 lbs./in.$^2$. On the other hand, the thermoplastic material is also chosen such that the buns 14 and skins 16 are substantially rigid when cooled below the plastic temperature range of the thermoplastic material.

Figure 2:
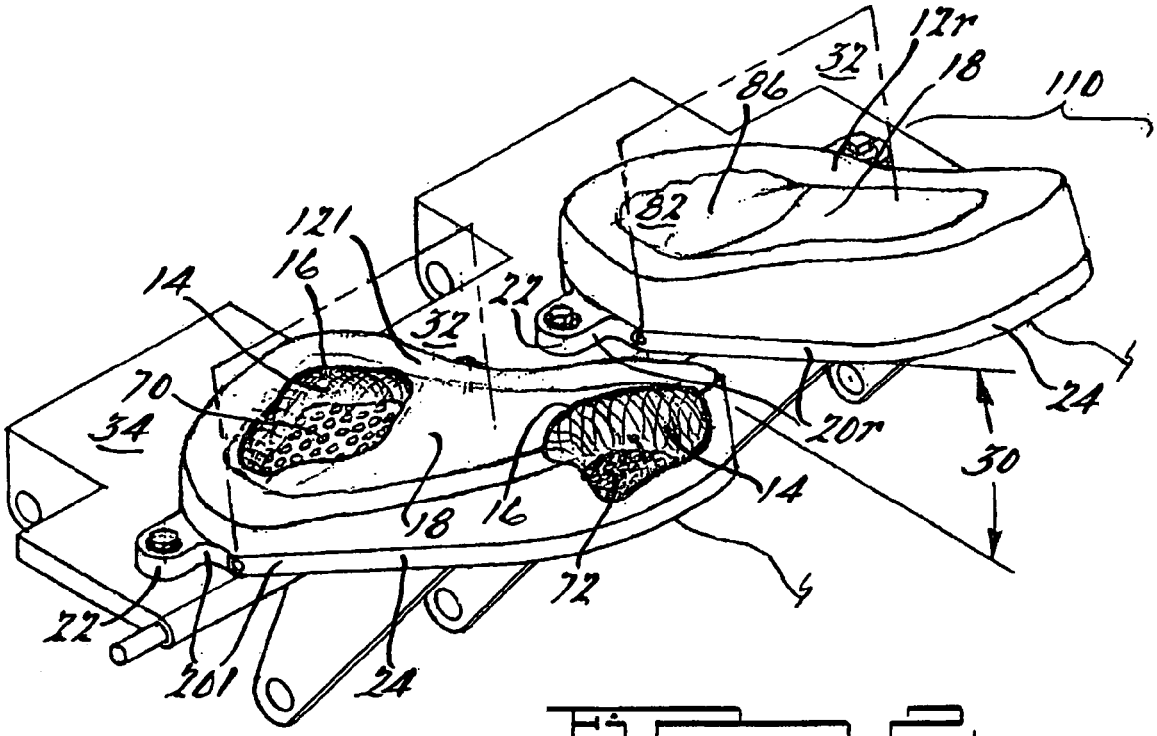
FIG. 2 is an isometric view of impression and pivoting platforms utilized on the foot impression generating apparatus.

As particularly shown in FIG. 2, each impression platform 12*l* or 12*r* comprises a base 20*l* or 20*r* for sealingly mounting the skins 16 such that, other than for selected heating and cooling air-flow paths, the air mass instantly contained within the open-cells of the buns 14 is substantially contained within the skins. Generally, the bases 20*l* have forefoot supporting portions 22 and hinge mounted trailing portions 24. The forefoot supporting portions 22 have lofted surfaces (not shown) whereon great toe supporting portions are slightly elevated. The trailing portions 24 also have lofted surfaces (not shown) where the arch supporting portions are slightly elevated. The trailing portions 24 can be angularly elevated with reference to the forefoot supporting portions 22 at selected trailing portion angles 30 ranging from 0 degrees to perhaps 25 degrees whenever the buns 14 and skins 16 are in their flexible state (e.g., when heated above the melting temperature of the thermoplastic material). The transitions between forefoot supporting and trailing portions 22 and 24 are meant to coincide with the balls of the feet whereby their locations along the lengths of the foot impressions are in fact utilized as vertical reference planes 32 when digitally recording full-length foot impression contours as described below.

In more minute detail, the lofted forefoot supporting and trailing portions 22 and 24 are chosen in concert with selected contours for the buns 14 and skins 16. Actual bun and skin contours as well as lofting details and skin thickness are determined via experimentation and testing. The goal with each impression platform design is to generate ideal foot impressions 18 with anatomically correct arch, outer foot and lessor toe placement for a broad range of foot types.

The forefoot supporting portions 22 are fixedly positioned on a pivoting platform 34 as by bolts 28. And as shown in greater detail in FIGS. 3A, 3B and 3C, the pivoting platform 34 is in turn pivotally mounted on a supporting frame structure 36 such that the trailing portions 24 can be located horizontally for ease in stepping into the impression platforms 12*l* and 12*r* after the buns 14 and skins 16 are in their flexible state. As shown in FIG. 1, the supporting frame structure 36 additionally features support rails 38 as an aid for a consumer.

Figure 3A:
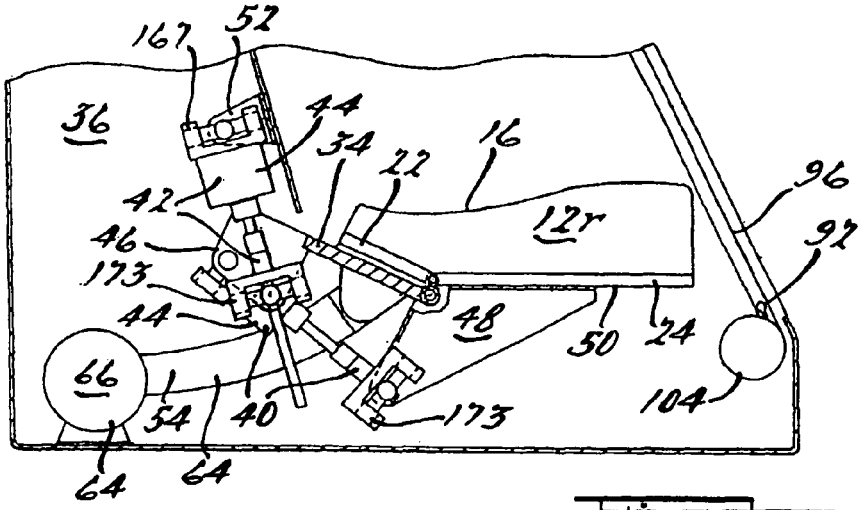
FIGS. 3A, 3B and 3C are side views of elevation drives for the impression and pivoting platforms.
Figure 3B:
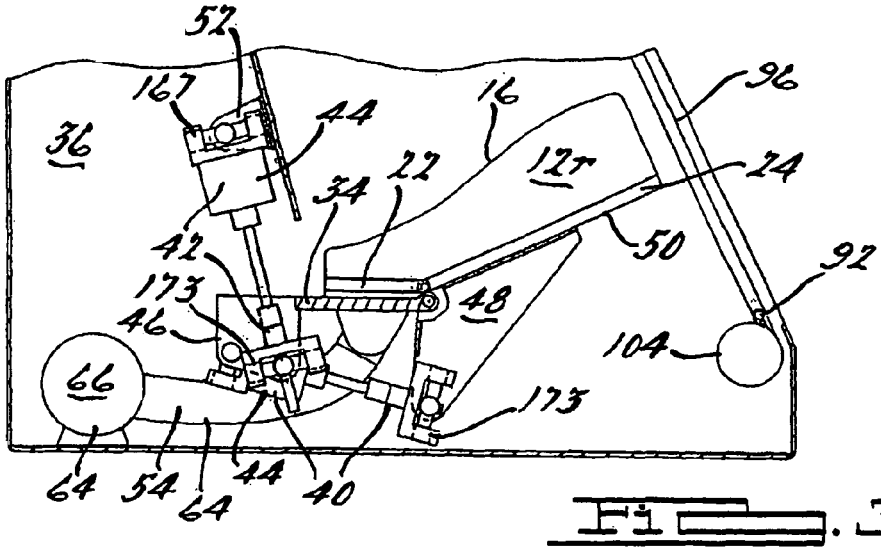

The pivoting platform 34 is initially located in a sloping mounting position whereat the trailing portions 24 are nominally horizontal such as depicted in FIG. 3A for a trailing portion angle 30 of 25 degrees. This serves to enable a consumer to readily step into the impression platforms 12*l* and 12*r*. As depicted in FIG. 3B, the pivoting platform 34 is next pivoted forward to a horizontal position such that the forefoot supporting portions 22 are located in their nominally horizontal reference positions with the trailing portions 24 elevated. This serves to enable the consumer to properly form the foot impressions 18. When the consumer is comfortable with his or her foot impression position, the buns 14 and skins 16 are cooled below the melting temperature of the thermoplastic material. After the foot impressions are "frozen", the pivoting platform 34 is pivoted back to its initial position thus enabling the consumer to easily dismount.

Figure 3C:
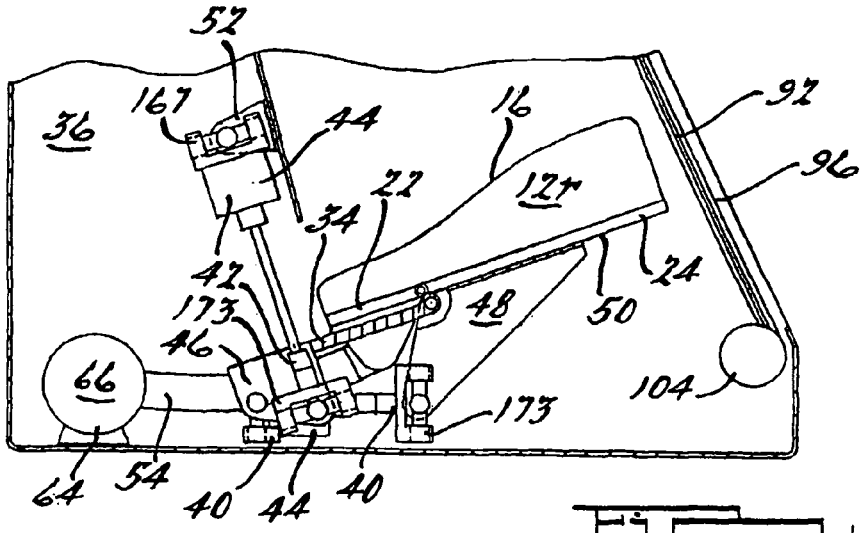

Depicted in their extreme operational positions in FIGS. 3A, 3B and 3C are elevation drives 40 and 42 respectively utilized for selectively elevating the trailing portions 24 and pivoting platform 34. A trailing portion angle 30 of 25 degrees requires full extension of the elevation drives 40 as shown in FIGS. 3A and 3B while they are fully contracted for trailing portion angles of 0 degrees as is shown in FIG. 3C. In addition, the elevation drive 42 is fully contracted in the initial mounting position for a trailing portion angle of 25 degrees as depicted in FIG. 3A while it is fully extended during the scanning operation described below for a trailing portion angle of 0 degrees as shown in FIG. 3C.

In detail, the elevation drives 40 and 42 are configured similarly to a kinematic lens positioning apparatus 107 described in U.S. Pat. No. 4,383,757 issued May 17, 1983 and entitled "Optical Focusing System" by Edward H. Phillips. In the kinematic lens positioning apparatus 107 a motor drive and gearbox assembly is mounted with reference to a supporting structure via a first universal joint assembly 167. The motor drive and gearbox assembly 169 directly drives a ball screw. The ball screw treadingly engages a ball nut that is mounted on and drives a second universal joint assembly 173. The second universal joint assembly 173 is mounted on and therefore serves to position a utilization device (e.g., a projection lens 13 in the '757 patent). For consistency, the same identification numerals are used herein in FIGS. 3A, 3B and 3C. The '757 patent is expressly incorporated by reference herein because the kinematic lens positioning apparatus 107 is fully described therein.

Herein however, stepping motors 44 are substituted for the motor drive and gearbox assembly 169 in order to provide discrete position information for the trailing portions 24 and pivoting platform 34. Otherwise each of the elevation drives 40 and 42 is similarly configured to the kinematic lens positioning apparatus 107 of the incorporated '757 patent. In the case of the elevation drives 40, stepper motor mounting first universal joint assemblies 167 are mounted on brackets 46 extending from the pivoting platform 34 and second universal joint assemblies 173 are mounted on and used to position levers 48. The trailing portions 24 are in turn positioned by the levers 48 via contact with their bottom surfaces 50. The elevation drive 42 is also similarly configured with another stepper motor mounting first universal joint assembly 167 mounted on a bracket 52 of the supporting frame structure 36 and another second universal joint assembly 173 positioning the pivoting platform 34 via the bracket 46. Again, the positioning apparatus itself is substantially identical with that used in the kinematic lens positioning apparatus 107 of the incorporated '757 patent. Because the positioning apparatus 107 is thoroughly described therein, there is no need to describe it further here.

Figure 4:
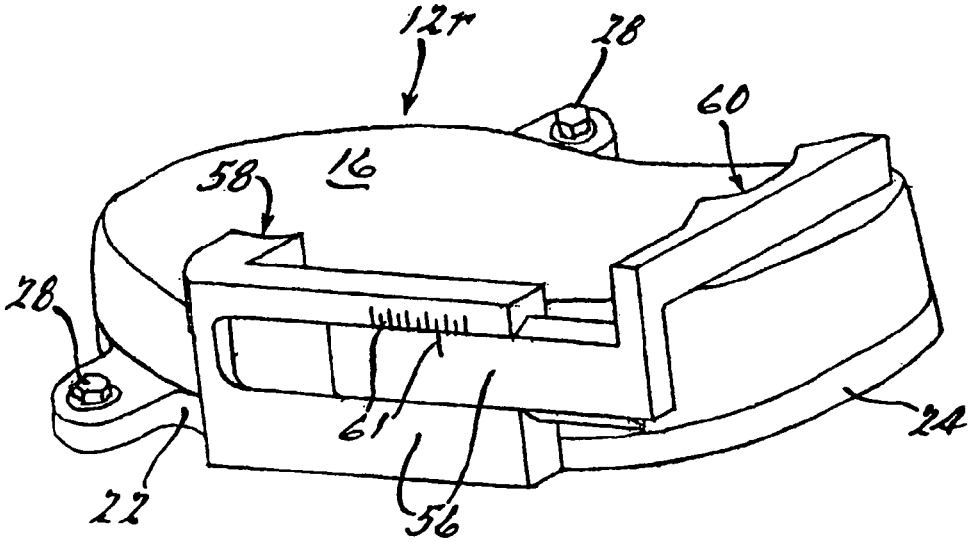
FIG. 4 is an isometric view of alignment apparatus utilized in conjunction with the impression platforms.

With reference now to FIG. 4, there shown is foot alignment apparatus 56 provided in conjunction with each of the trailing portions 24. For reasons of clarity, the foot alignment apparatus 56 has not been depicted in any of FIGS. 1, 2, 3A, 3B or 3C. However, its inclusion in the foot impression generating apparatus 10 is quite important because it allows the consumer to properly position his or her feet above trailing portions 24 before he or she steps into the heated impression platforms 12*l* and 12*r*. Thus, when a consumer does step into the heated impression platforms 12*l* and 12*r*, his or her feet are already aligned in preferred positions with reference to the vertical reference planes 32 as well as the scanning means yet to be described for digitally recording the foot impression contours.

The foot alignment apparatus 56 comprises lateral positioning gates 58 juxtaposed to each great toe metatarsal head, and adjustable form fitting longitudinal gates 60 juxtaposed to the rear of each heel. Preparatory to using the foot impression generating apparatus 10, the sizes of the consumer's feet are established by known means with reference to the distance between the great toe metatarsal heads and the rear of the heels via utilization of a Brannock device (not shown). This establishes the desired distance from the vertical reference planes 32 to the adjustable form fitting longitudinal gates 60 whereby the adjustable form fitting longitudinal gates 60 are physically positioned like distances from the vertical reference planes 32 via scales 61.

In addition, the adjustable form fitting longitudinal gates 60 are also utilized to measure changes in length of the trailing portions of the consumer's feet as the foot impressions 18 are being made. The consumer's feet are quite likely to change shape whenever foot impressions 18 are formed at higher valued trailing portion angles 30 because of concomitant shifting of weight to the forefeet. Generally at least two and preferably three sets of foot impressions 18 are taken for each consumer. This is because data relating to such foot changes (including changes in trailing portion length) is important in effecting composite data utilized in forming shoe inserts 62, such as those shown in FIG. 5, that are optimized for specific consumer activities.

Figure 6A:
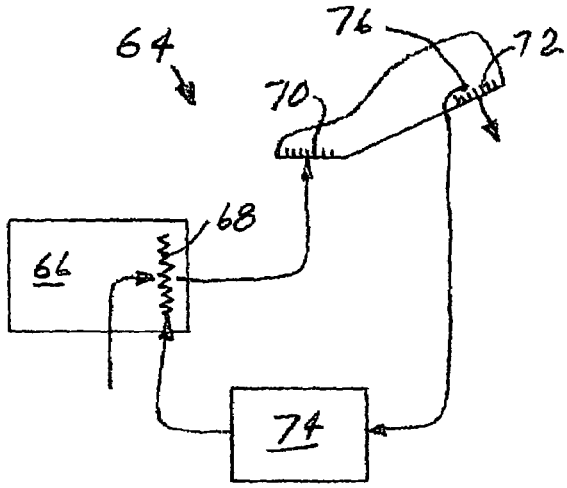
FIGS. 6A and 6B are schematic views of heating and cooling systems utilized in the foot impression generating apparatus.
Figure 6B:
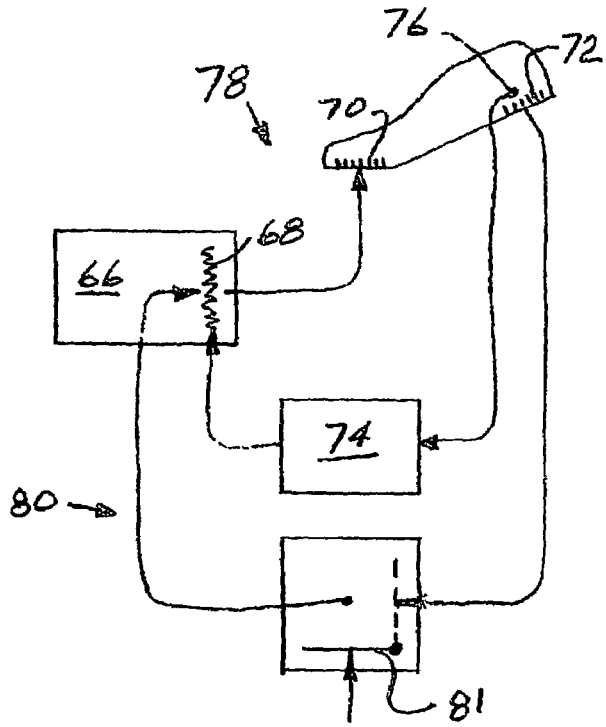

In order to effect heating and cooling of the buns 14 and skins 16, the foot impression generating apparatus 10 also comprises a heating and cooling system 64 or 78 such as respectively schematically depicted in FIGS. 6A and 6B with the simpler heating and cooling system 64 also being partially shown in FIGS. 3A, 3B and 3C. The heating and cooling system 64 includes a blower 66 equipped with a heating coil 68 in a manner similar to a hair dryer. Heated and then ambient air is circulated through the open-cell sponge material via a hose assembly 54 and then through inlet vents 70 formed in the forefoot supporting portions 22 and then exhausted through exhaust vents 72 at the rearmost parts of the trailing portions 24. The temperature of the heated air is maintained at a selected value slightly above the melting temperature of the thermoplastic material via controlled operation of electrical current flowing through the heating coil 68. This is accomplished by a temperature controller 74 in response to signals from temperature transducers 76 located in the exhaust vents 72. The ambient air is obtained by simply turning the temperature controller 74 off. The heating and cooling system 64 is mounted within the supporting frame structure 36 of the foot impression generating apparatus 10 as partially depicted in FIGS. 3A, 3B and 3C.

As depicted in FIG. 6B, the somewhat more elaborate heating and cooling system 78 includes a damper activated air re-circulation system 80 that is utilized in conjunction with the blower 66, heating coil 68 and temperature controller 74. In this case the heated air is recovered from the exhaust vents 72 and then re-circulated through the blower 66 and heating coil 68. The temperature of the heated air is still maintained at a selected value slightly above the melting temperature of the thermoplastic material via controlled operation of electrical current flowing through the heating coil 68. However, the temperature controller 74 only needs to account for net heating losses because the heated air is re-circulated via damper 81. Thus operation is more efficient and significantly less heat is dumped into the immediate surrounding environment. The damper 81 is of course repositioned in order to deactivate the air re-circulation in conjunction with turning the temperature controller 74 off in order to obtain the cooling flow of ambient air.

As already noted above, it has been found experimentally that foot shapes usually change significantly as the trailing portion angle 30 is varied. Perhaps the most noticeable change is a radical reduction in pronation for those so afflicted. In any case, these changes occur because the metatarsal heads and toes support a greater percentage of the consumer's weight as the trailing portion angle 30 is increased. This requires altered and increased flexure of muscles utilized for extending the foot about the ankle joint and for delivering weight supporting force to the metatarsal heads and toes. While the most obvious action is that of forces delivered to the heels by the calf muscles via the Achilles tendons, other supporting muscles arise from the leg bones and deliver force directly to the metatarsal heads via long tendons that bypass the ankle joints. Still other muscles arise from the heel and deliver force to the toes via tendons that bypass the metatarsal heads. All of this results in significant displacement of the heels, increasing prominence of the first metatarsal head, more lateral alignment of the metatarsal heads, and in significant changes in disposition of the metatarsus generally.

In greater detail, it has been found experimentally that as the trailing portion angle 30 increases, the heels and the metatarsal heads are drawn toward one another such that the heels are lowered and move toward the metatarsal heads by as much as 0.150 inch (e.g., the trailing portions of the feet actually shorten). And as a result of this, the arches become more pronounced. This is especially so nearest the heels where the deviation can be as much as 0.250 inch. Lateral alignment of the metatarsal heads varies as well with the first metatarsal heads being lowered and the fifth metatarsal heads becoming elevated because the first through fourth metatarsal heads disproportionately support greater weight than the fifth. This in turn causes the fifth metatarsal bones to become less prominent vertically but move laterally outward.

Figure 5:
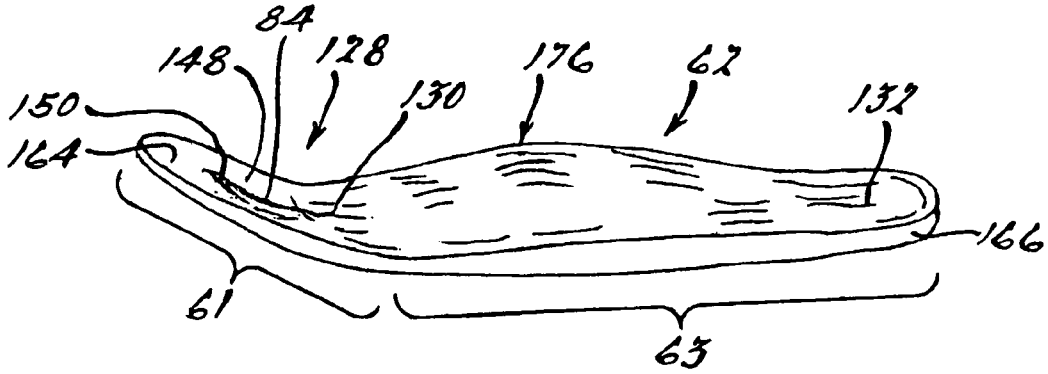
FIG. 5 is a perspective view of a finished shoe insert.

Another problem is that the forwardly extending portions of the balls of the feet become more prominent as the trailing portion angle 30 is increased. Thus even as the length of the trailing portions of the feet shorten, curvilinear distances from the vertical reference planes 32 to toe impressions 82 increase with the result that overall length of the foot impressions 18 remains about the same. In any case, the toe impressions 82 extend further along curvilinear path 84 (e.g., as shown in FIG. 5) from the vertical reference planes 32 as the trailing portion angle 30 is increased. In addition, toe crest or sulcus filling mounds located between the balls of the feet and the toes present in the foot impressions 18 become better defined and differently placed.

In general, the problem then is to somehow utilize the foot impression generating apparatus 10 for generating a composite form of foot impressions 18 taken at various trailing portion angles. Such a composite form of the foot impressions 18 can then become useful in forming shoe inserts 62 that adequately support the feet during activities ranging from sedentary to walking or even running. This must be done despite the obvious fact that perfectly formed shoe inserts 62 for ideally supporting the feet during each activity and during each segment of each dynamically varying activity differ significantly.

Trailing portion angles 30 are chosen in accordance with the intended dynamic range of any particular shoe inserts 62. In general at least two and preferably three sets of foot impressions 18 are taken for forming any pair of shoe inserts 62. In general, rearmost regions of all shoe inserts 62 should be representative of foot impressions 18 taken at a 0 degree training portion angle 30. More forward regions thereof should be representative of a graduated blending to and of foot impressions 18 taken at 12.5 and 25 degree trailing portion angles 30. And forefoot regions should be representative of the foot impressions 18 taken at a 25 degree trailing portion angle. However, shoe inserts intended for athletic use such as in a pair of track shoes would blend more quickly toward mimicking foot impressions taken higher valued trailing portion angles than those intended for use in more sedentary activities.

After each set of foot impressions 18 is formed it is scanned by non-contacting scanning means 88. As shown in FIG. 1, it is convenient to position the non-contacting scanning means 88 well forward of the consumer's position while he or she is standing on the foot impression generating apparatus 10 and thus out of his or her way while the foot impressions 18 are being formed. Rather than move the non-contacting scanning means 88 over the foot impressions 18, it is then convenient to simply rotate the pivoting platform 34 into a position where the trailing portion 24 is nominally orthogonal to the nominal scanning axis of the non-contacting scanning means 88 prior to the scanning operation in the manner depicted in FIG. 3C.

In any case, digital "point cloud data" resulting from the scanning operation is processed in a manner whereby digitized foot impression contour maps 90*r*, 90*m* and 90*f* (hereinafter "digitized foot impressions 90*r*, 90*m* and 90*f*") are formed. Suitable non-contacting scanning means 88 for creating digital "point cloud data" that is representative of the foot impressions 18 is available from Steinbichler Optotechnik GmbH of Neubeuern, Germany. Suitable software for forming and manipulating polygonal master model or other surface descriptive digital files (hereinafter "polygonal master model files" for convenience) from the point cloud data and thereby forming digitized foot impressions 90*r*, 90*m* and 90*f* is available from Innovmetric Software Inc. of Sainte-Foy, Quebec, Canada under the trade name "PolyWorks/Modeler", and/or Gibbs and Associates of Moorpark, Calif. under the trade names "Virtual Gibbs" and "GibbsCam".

Various types of devices are suitable for use as non-contacting scanning means 88. Some of these devices are "white light" optical devices nominally requiring a darkened environment. Thus although not required for use with all forms of non-contacting scanning means 88, an optional shade 92 for substantially excluding ambient light from the area of the foot impressions 18 is depicted in FIGS. 1, 3A, 3B and 3C. The shade 92 is housed in a reel 104 while the foot impressions 18 are being formed as depicted in FIGS. 3A and 3B. It is unfurled along channels 96 as depicted in FIG. 3C and retained by hooks 98 and eyes 100 (shown in FIG. 1) during the scanning operation.

Figure 7:
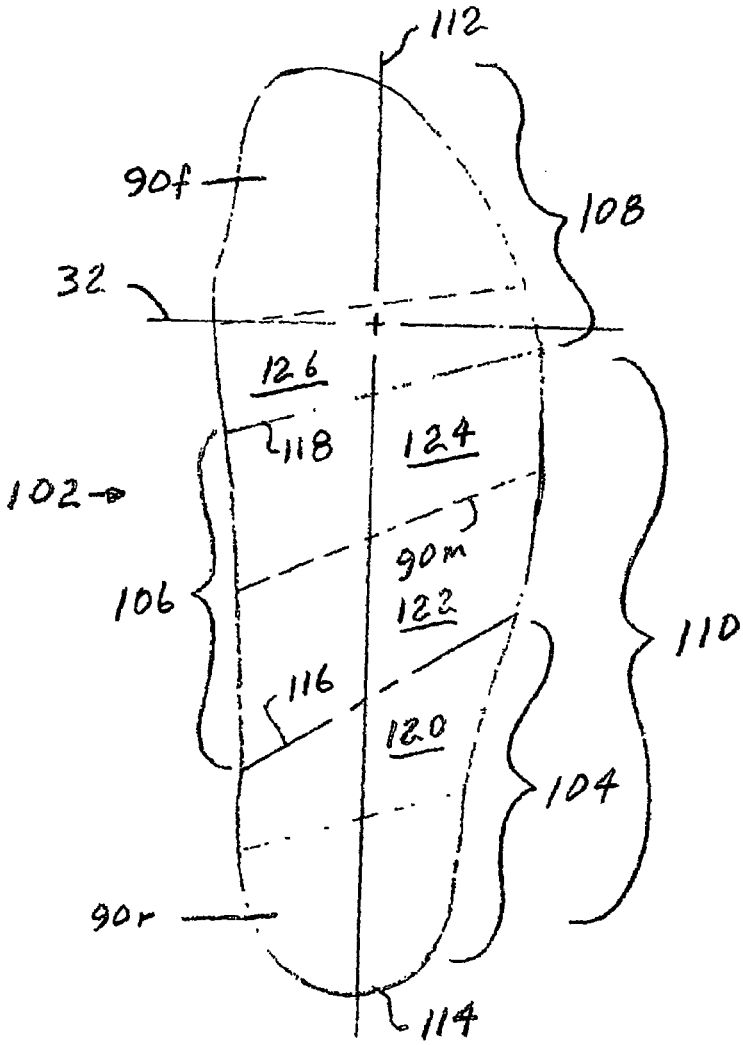
FIG. 7 is a plan view of a composite digitized foot impression.

With reference now to FIG. 7, there depicted is a blending of digitized foot impressions 90*r*, 90*m* and 90*f* into a composite set of digitized foot impressions 102 (hereinafter either "composite set of digitized foot impressions 102" or more simply "composite digitized foot impressions 102") such that shoe inserts 62 resulting therefrom support the feet in an acceptable manner. For instance, it is first necessary to properly support a consumer's feet as they become load supporting in a planar manner. Then under dramatically different conditions it is also necessary to properly support more forward regions of the feet as he or she "strides through". Finally, is also necessary to properly support the balls and toes of the his or her feet when they become load bearing during "toeing off" with the trailing portion of the feet disposed at a significant trailing portion angle. Thus, a set of digitized foot impressions 90*r* made with a 0 degree trailing portion angle 30 predominantly influences the rear through outer rear regions 104 of the composite set of digitized foot impressions 102. A set of digitized foot impressions 90*m* made with a mid-range trailing portion angle 30 of perhaps 12.5 degrees predominantly influences the rear arch through more forward outer regions 106. A set of digitized foot impressions 90*f* made with the highest trailing portion angle 30 of perhaps 25 degrees predominantly influences the front arch through forefoot supporting regions 108 of the composite set of digitized foot impressions 102. And a virtual graduated blending between each is formed as described below.

Two predominant feature changes occur as the trailing portion angle 30 increases. Firstly, there is a dramatic reduction in pronation. This is implemented in the form of an inward rotation of the metatarsus. By way of example, a line more-or-less parallel to the present inventor's metatarsal heads nominally varies from 8 degrees to 2 degrees to −2 degrees of pronation as the trailing portion angle 30 is changed from 0 degrees to 12.5 degrees to 25 degrees. Most notably, this change is evidenced by a pronounced downward extension of the first metatarsal such as to position the first metatarsal head whereat the great toe can become significantly load bearing. Interestingly, there is little or no corresponding roll direction rotation of the heel.

A second and complicating feature change is that the heels concomitantly move downward and forward at the larger trailing portion angles 30 thus foreshortening the rearmost portions 110 of the foot impressions 18. This is accounted for by compressionally distorting the digitized foot impression data along longitudinal axes 112 over the rear portion of the distance from the vertical reference planes 32 to the rear of the heel regions 114 for digitized foot impressions 90*r* and 90*m*. Thus, differences in the distances measured from the vertical reference planes 32 to the adjustable form fitting longitudinal gates 60 are accounted for only over those compressionally distorted distances.

In greater detail, mean average lines 116 having contour values half way between those of digitized foot impressions 90*r* and 90*m*, and 118 having contours half way between those of digitized foot impressions 90*m* and 90*f* are respectively established between regions 104 and 106, and 106 and 108. In any case, transition zones 120 and 122, and 124 and 126 are respectively established on either side of the mean average lines 116 and 118 wherein contour values smoothly undergo transition from purely those of digitized foot impressions 90*r* in the rear through outer rear regions 104 to digitized foot impressions 90*f* in the forefoot supporting regions 108. As already mentioned, shoe inserts 62 intended for a runner have regions 104, 106 and 108 as well as the mean average lines 116 and 118 therebetween biased toward the rear of the composite set of digitized foot impressions 102 while those intended for more sedentary activities are biased toward the front thereof.

The result is that shoe inserts 62 made from the composite digitized foot impressions 102 support the heel, arch and outer portions of the feet generally with their proper pronation while they are in contact with the ground. Otherwise the outer portions of the feet will feel constrained and resulting muscle strain is likely to appear in the inner ankle areas and in outer quad areas of the legs (e.g., above the knees). At the same time, the metatarsus is properly supported prior to "toe off" and the balls of the feet and toes are properly supported during "toe off". Otherwise metatarsal strain is likely and proper "toe off" will be impeded. Furthermore, there is a real danger of developing Achilles tendonitis if the first metatarsal is not allowed to extend downward as it becomes load bearing.

Of course, using this strategy for forming shoe inserts 62 means that while the feet are disposed in a planar weight-supporting manner, the arch areas of a consumer's feet (not shown) are somewhat over-supported and the balls of the feet are located a little too far forward because the heels are constrained by heel counters typically present in shoes (not shown). These faults seem to be adequately tolerated however. Specifically in the case of the balls of the feet being located too far forward, there is adequate room for them because the shoe inserts 62 are formed with generous concave "pockets" 128 (e.g., shown in FIG. 5) as a result of the curvilinear distance along curvilinear path 84 having been increased during the formation of the foot impressions made at the greater trailing portion angles 30. When "toeing off", the balls of the feet then actually slide rearward into their "nested positions" 130 with the heels remaining in a fixed location with respect to the heel counters and heel portions 132 of the shoe inserts 62.

A method of creating digitized foot impressions representative of the bottom foot contours of a consumer's feet is presented in a first alternate preferred embodiment of the present invention. First, the lengths of the consumer's feet are measured with a Brannock device. Then the foot alignment apparatus 56 is set according to those measurements. Next the impression platforms 12*l* and 12*r* are heated slightly above the melting temperature of the thermoplastic material whereby the impression platforms adopt elastomeric properties as determined by the constituent elastomeric material. Then the trailing portions 24 are positioned at a selected trailing portion angle 30 wherefrom either of the trailing portions 24 can be further elevated by a selected supplemental elevation angle 30' to compensate for the consumer having one leg shorter than the other. The pivoting platform 34 is then negatively positioned at the inverse of the selected trailing portion angle 30 (e.g., for other than foot impressions to be taken at a valued trailing portion angle 30 of 0 degrees) such that the trailing portions 24 are nominally horizontal.

Next (e.g., with the impression platforms 34 maintained at their proper impression platform temperature), the consumer aligns his or her feet with reference to the foot alignment apparatus 56. Then he or she steps into the impression platforms 12*l* and 12*r* thereby deforming the buns 14 and skins 16 in an elastomeric manner. Then (e.g., again for non-zero valued trailing portion angles 30) the pivoting platform 34 is forwardly rotated to its reference position whereat a significant portion of the consumer's weight is supported by his or her toes over the horizontally disposed forefoot supporting portions 22 in dependence upon the trailing portion angle 30. Then the lengths of the consumer's feet are again checked with the adjustable form fitting longitudinal gates 60.

Next, the impression platforms 12*l* and 12*r* are rapidly cooled to a lessor temperature than that of the low temperature end of the plastic range of the thermoplastic material. This serves to "freeze" the buns 14 and skins 16 of both impression platforms 12*l* and 12*r* in their deformed positions. After the buns 14 and skins 16 are frozen, the pivoting platform 34 is returned to its negatively positioned location whereat the trailing portions 24 of non-further elevated bases 20*l* and 20*r* are again horizontal. Then the consumer removes his or her weight and feet from the impression platforms 12*l* and 12*r* leaving a finished pair of foot impressions 18 impressed therein. Finally, the contours of the foot impressions 18 are scanned in order to form point cloud data representative of the foot impressions 18. The point cloud data is converted to a polygonal master model file and stored as a first set of digitized foot impressions 90.

The above procedure is repeated utilizing the remaining selected trailing portion angles 30 thus creating sequential stored sets of digitized foot impressions 90*r*, 90*m* and 90*f*. Finally a composite set of digitized foot impressions 102 is formed in compliance with the above discussion relating to FIG. 7 and stored in a consumer's file. The consumer's file also includes his or her shoe type and size. It also includes any supplemental elevation angle 30' utilized for either foot impression 18 in the event that one of the consumer's legs is shorter than the other.

Figure 8:
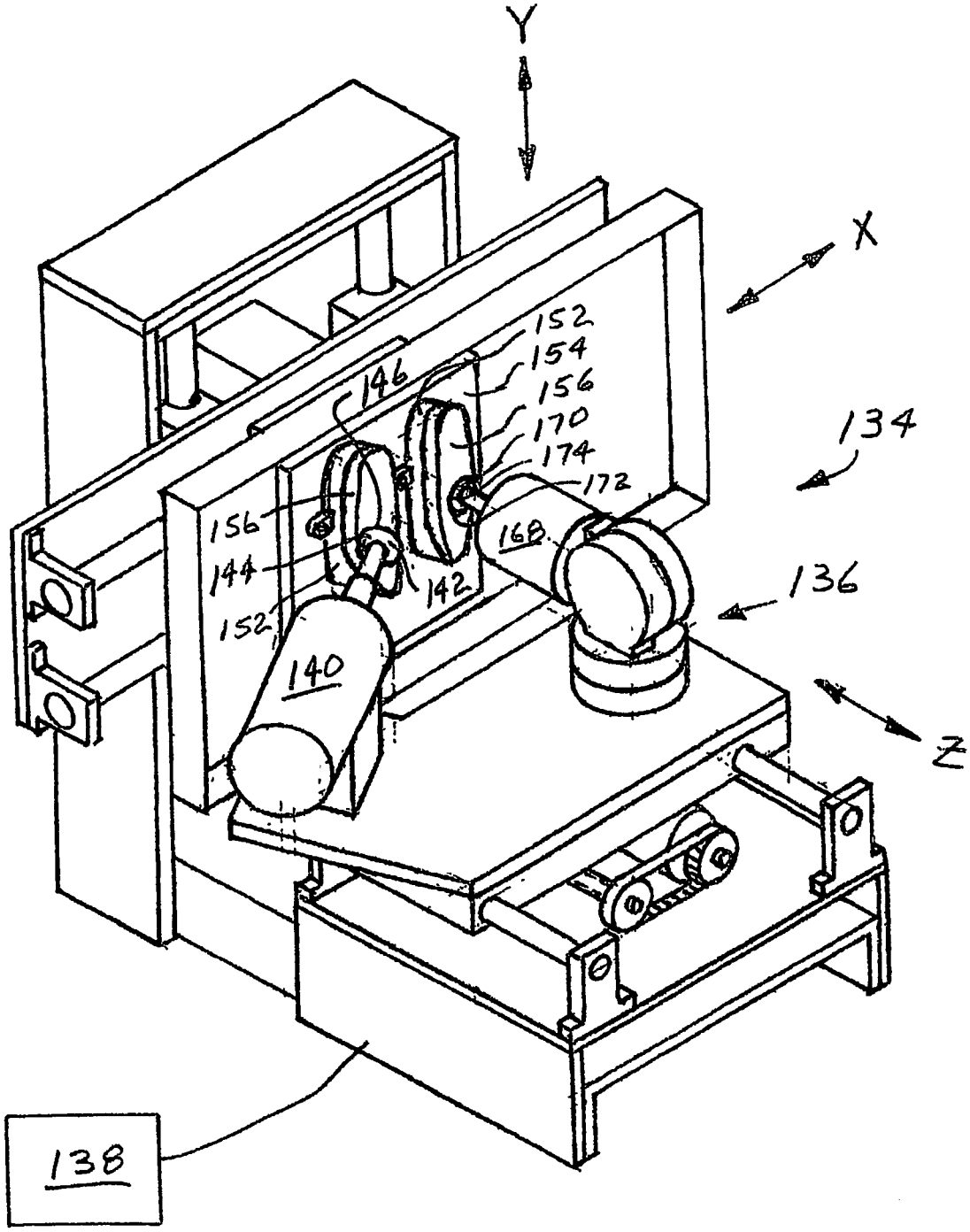
FIG. 8 is an isometric view of a digitally controlled milling machine.

Because the consumer's information is stored in the consumer's file, there is no requirement for shoe insert generating apparatus 134 comprising a digitally controlled milling machine 136 and controls 138 therefor as depicted in FIG. 8 to be proximate to the foot impression generating apparatus 10. In fact, the shoe insert generating apparatus 134 can be located anywhere. It can of course be proximate to the foot impression generating apparatus 10 whereby finished shoe inserts 62 can be directly presented to the consumer. At the opposite extreme, the consumer's file can be e-mailed to a remote shoe insert fabrication center whereat the shoe inserts 62 are formed on shoe insert generating apparatus 134 and then shipped to the consumer.

Figure 9:
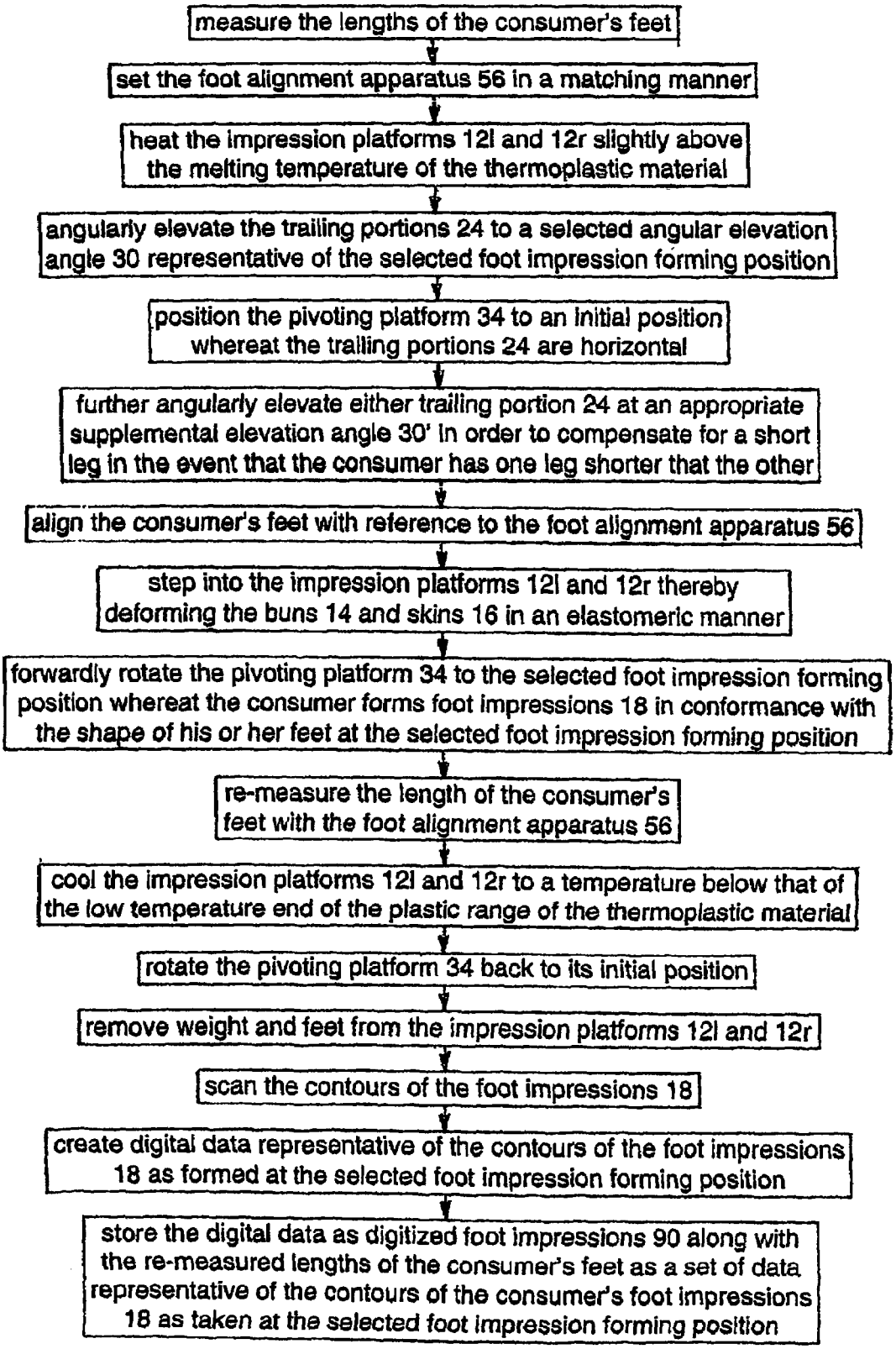
FIG. 9 is a flow chart depicting a preferred method of creating digitized foot impressions.

In accordance with a flow chart depicted in FIG. 9 then, a preferred method of creating digitized foot impressions 90 representative of the bottom foot contours of a consumer's feet at a selected foot impression forming position via utilization of a foot impression generating apparatus 10 comprising foot alignment apparatus 56 and impression platforms 12*l* and 12*r* including buns 14 of blown open-cell sponge material bonded to and supporting non-porous skins 16 formed of non-blown sponge material wherein the buns 14 and skins 16 are mounted upon a pair of bases 20*l* and 20*r* having forefoot supporting and angularly elevatable trailing portions 22 and 24, respectively, longitudinally separated by vertical reference planes 32 with the forefoot supporting portions 22 being in turn supported upon a pivoting platform 34 comprises the steps of: measuring the lengths of the consumer's feet; setting the foot alignment apparatus 56 in a matching manner; heating the impression platforms 12*l* and 12*r* slightly above the melting temperature of the thermoplastic material; angularly elevating the trailing portions 24 to a selected angular elevation angle 30 representative of the selected foot impression forming position; positioning the pivoting platform 34 to an initial position whereat the trailing portions 24 are horizontal; further angularly elevating either trailing portion 24 at an appropriate supplemental elevation angle 30' in order to compensate for a short leg in the event that the consumer has one leg shorter that the other; the consumer aligning his or her feet with reference to the foot alignment apparatus 56; the consumer stepping into the impression platforms 12*l* and 12*r* thereby deforming the buns 14 and skins 16 in an elastomeric manner; forwardly rotating the pivoting platform 34 to the selected foot impression forming position whereat the consumer forms foot impressions 18 in conformance with the shape of his or her feet at the selected foot impression forming position; re-measuring the length of the consumer's feet with the foot alignment apparatus 56; cooling the impression platforms 12*l* and 12*r* to a temperature below that of the low temperature end of the plastic range of the thermoplastic material; rotating the pivoting platform 34 back to its initial position; the consumer removing his or her weight and feet from the impression platforms 12*l* and 12*r*; scanning the contours of the foot impressions 18; creating digital data representative of the contours of the foot impressions 18 as formed at the selected foot impression forming position; and storing the digital data as digitized foot impressions 90 along with the re-measured lengths of the consumer's feet as a set of data representative of the contours of the consumer's foot impressions 18 as taken at the selected foot impression forming position.

In accordance with a flow chart depicted in FIG. 10, a preferred method of creating a composite set of digitized foot impressions 102 representative of a selected blending of at least two sets of data representative of the contours of the consumer's foot impressions 18, where each of the at least two sets of data have previously been determined at selected foot impression forming positions according to the method depicted in FIG. 9, wherein the method comprises the steps of: compressionally distorting the digitized foot impression or impressions data comprised in the set or sets of data representative of the contours of a consumer's foot impressions 18 taken at the lessor trailing portion angle 30 or angles 30 over the rear portion of the distance from the great toe metatarsal heads to the rear of the heels such that the resulting distance between the great toe metatarsal heads and the rear of the heels comprised in the set or sets of the so modified digitized foot impression data is or are equal to that of the set of data representative of the contours of the consumer's foot impressions 18 taken at the greater trailing portion angle 30; positioning the sets of so modified digitized foot impression data progressively along the longitudinal axis of the composite set of digitized foot impressions 102 with the digitized data from the set of data representative of the contours of the consumer's foot impressions taken at the largest trailing portion angle 30 positioned forwardly and those taken at the smallest trailing portion angle 30 rearwardly with the respective sets of digitized data generally disposed to either side of a mean average angularly skewed line or lines extending from inside to outside of the composite set of digitized foot impressions in a generally forward direction or directions; and establishing transition zones on either side of the mean average line or lines such that there is a smooth transition between digitized data from the set of data representative of the contours of the consumer's foot impressions taken at the largest trailing portion angle 30 generally present from the forward portion of the instep through the forefoot supporting regions to digitized data from the set of data representative of the contours of the consumer's foot impressions taken at the smallest trailing portion angle 30 generally present from the rear of the fifth metatarsal through the heel regions, with the fully implemented composite set of digitized foot impressions along with the consumer's identification, shoe type and size, and any supplemental elevation angle 30' utilized in a personal file ready for use in shoe insert generating apparatus.

It is known to utilize hemispherical cutters for shaping shoe inserts from shoe insert blanks. In order to accurately generate shoe insert contours from the composite set of digitized foot impressions via utilization of such hemispherical cutters it is of course necessary to provide tool radius compensation for the hemispherical cutters whereby digital control information fed to the Z-axis position control is selectively modified.

Herein however, should a polygonal master model file comprise a surface contour section with a concave curved segment having a smaller radius than the hemispherical cutter radius, it clearly would not be possible to generate tool radius compensation offset corrections for that concave curved segment for such a hemispherical cutter. The next problem to be solved then relates to the fact that concave curved segments with radii smaller than those of normally utilized hemispherical cutters (i.e., 0.500 inch) often occur near the outer edges of laterally oriented surface contour sections.

Two methods of solving this anomaly are presented herein in first and second methods of forming shoe inserts 62 respectively presented in second and third alternate preferred embodiments of the present invention. In both cases, the shoe inserts 62 are formed from insert blanks made from a material, such as ethyl vinyl acetate (EVA), that is somewhat pliable in order to accommodate flexure of the forefoot regions as a consumer toes off during normal walking or running activities. Both methods of forming shoe inserts 62 are executed in the shoe insert generating apparatus 134 comprising the digitally controlled milling machine 136 and controls 138 therefor shown in FIG. 8.

Structurally, the digitally controlled milling machine 136 is configured in a known manner as a light duty digitally controlled milling machine. Since an adequate general description of such a typical light duty digitally controlled milling machine and its operation is presented in the incorporated '758 patent wherein such apparatus is identified as the "shaping unit 216" and depicted in FIG. 10 thereof, there is no need to describe the basic construction and general operation of the digitally controlled milling machine 136 and controls 138 therefor in detail here. Herein however, pairs of shoe inserts 62 are formed with their longitudinal axes parallel to the "Y-axis" in the digitally controlled milling machine 136. Operationally however, the primary cutting motion is still along the "X-axis" with a stepping motion executed along the "Y-axis" between cutting motions.

As opposed to the high speed shaping motor 238 and hemispherical cutter 240 described in the incorporated '758 patent however, a milling spindle 140 of the digitally controlled milling machine 136 is laterally rotated in a plane parallel to the "X-axis" and utilizes a dovetail cutter 142 for cutting the surface contour of the shoe inserts 62 in laterally directed passes along the "X-axis". The milling spindle 140 is rotated by perhaps 60 degrees while the dovetail cutter 142 has an apex angle 144 of perhaps 60 degrees with the apex radius 146 thereof configured with a relatively small radius of perhaps 0.100 inch. This makes it possible to eliminate laterally directed tool radius compensation offset correction in the trailing portions 63 of the shoe inserts 62. This is because the cutting error would then be limited to an acceptable 0.013-inch for a 30-degree lateral slope.

In the first method of forming shoe inserts 62, a relatively small dovetail cutter 142 having a radius such as 0.400 inch is utilized. This makes it possible to eliminate tool radius compensation offset correction in the longitudinal direction as well. This is because the cutting error would again be limited to an acceptable 0.013-inch for a 15-degree longitudinal slope.

On the other hand, longitudinally directed tool radius compensation offset correction is implemented in the second method of forming shoe inserts 62. Thus, there is no such limitation on dovetail cutter radius. The result is that slopes in the trailing portions 63 are cut without error in the longitudinal direction.

In general, digitized foot impressions 90*f* define toe crests or sulcus filling mounds 148 between the balls of the feet and the toes. However, virtually all consumers would find complete toe crests or sulcus filling mounds 148 to be excessively confining if they were precisely reproduced in forefoot supporting portions 61 of their shoe inserts 62.

In the first method of forming shoe inserts 62, the problem is automatically handled because the front surfaces of concave cavities for accommodating the balls of the feet (e.g., that are formed in the forefoot supporting portions 61) are disposed at a significant angle with the longitudinal or X-axis of the digitally controlled milling machine 136. Thus they are cut deeper than the virtual front surfaces comprised in the digitized foot impressions 90*f* which reduces toe crests or sulcus filling mounds 148 as desired.

In the second method of forming shoe inserts 62 the problem is similarly handled by selectively modifying the longitudinally directed tool radius compensation offset correction in the forefoot supporting portions 61. In essence the assumed tool radius is selectively reduced. Thus front surfaces 150 of concave "pockets" 128 formed in the forefoot supporting portions 61 for accommodating the balls of the feet are again cut deeper than corresponding virtual front surfaces comprised in the digitized foot impressions 90*f* which again reduces toe crests or sulcus filling mounds 148 as desired.

Additionally in the second method of forming shoe inserts 62, it is possible to utilize a fictitious negative tool radius compensation offset correction in the lateral direction in the forefoot supporting portions 61. This results in any laterally oriented slopes therein being cut more deeply as well. The resulting lateral freedom provides for some lateral movement of the toes.

Figure 11:
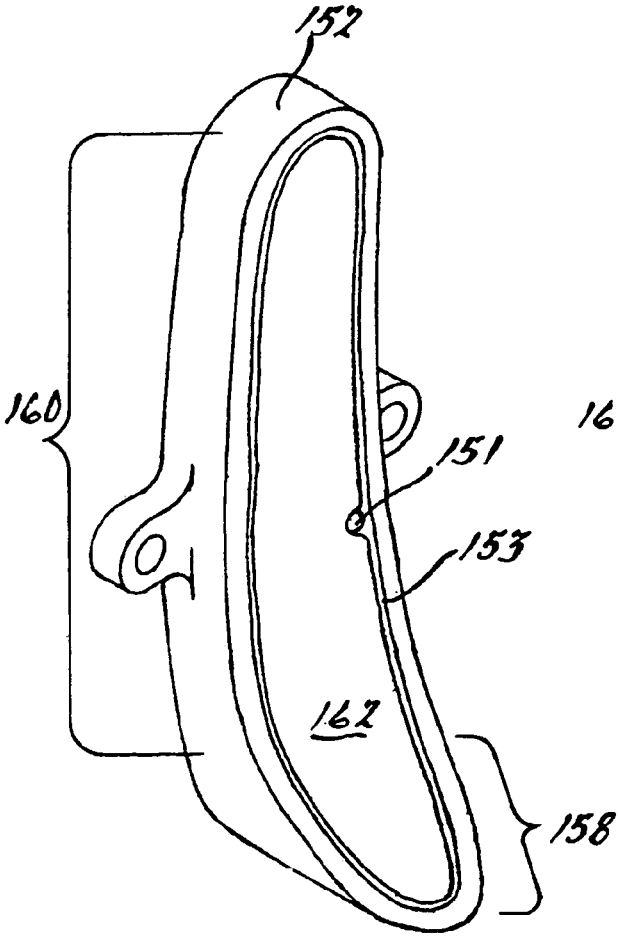
FIG. 11 is an isometric view of a vacuum chuck utilized in the digitally controlled milling machine.
Figure 12:
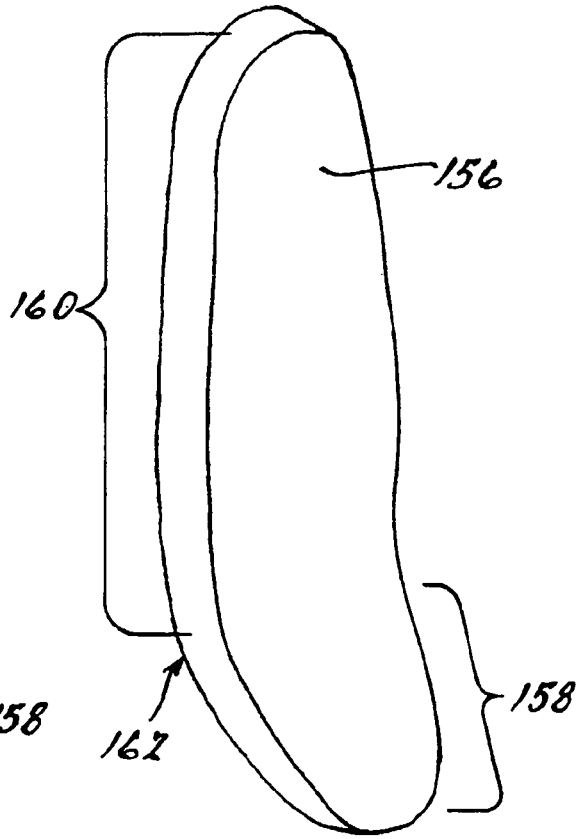
FIG. 12 is an isometric view of a shoe insert blank.

In either method however, the first step in actually fabricating a pair of shoe inserts 62 from a pair of a composite set of digitized foot impressions 102 involves positioning the composite digitized foot impressions 102 in virtual space with respect to a set of shoe insert blank supporting devices 152 mounted on table 154 of the digitally controlled milling machine 136 (hereinafter "table 154"). The set of shoe insert blank supporting devices 152 is utilized for holding a pair of precut or pre-molded shoe insert blanks 156 such as the one shown in FIG. 12. The exemplary shoe insert blank supporting device 152 depicted in FIG. 11 is a vacuum chuck 152 that utilizes a vacuum port 151 and grooves 153 for holding such a shoe insert blank 156 by suction. Alternately, it could be a simple block (not shown) utilizing temporary adhesive bonding for holding a shoe insert blank 156 from which a shoe insert 62 is to be formed.

Generally, the pair of composite digitized foot impressions 102 will be properly positioned in the roll, yaw, X and Y directions as a result of consistency between the original placement of the feet on the impression platforms 12*l* and 12*r* by the foot alignment apparatus 56 and the shoe insert blank 156 placement as well as the shoe insert forming methods yet to be described. However, the composite digitized foot impressions 102 need to be positioned in the pitch and Z directions with respect to the table 154 such that minimum clearance values of perhaps 0.150 inch are maintained between the composite digitized foot impressions 102 and the shoe insert blank supporting devices 152.

An exception would of course be for accommodating a short leg by maintaining the supplemental elevation angle 30' for that composite digitized foot impression 102 as specified in the consumer's personal file. This would provide a greater clearance distance from that shoe insert blank supporting device 152 for that composite digitized foot impression 102, and would of course result in a thicker trailing portion of that shoe insert 62.

In addition, the actual angle that forefoot supporting regions 108 of the composite digitized foot impressions 102 then make with reference to the table 154 must be accommodated through selection of a set of shoe insert blank supporting devices 152 having appropriate upward slopes in their forefoot supporting portions 158. In general, both the shoe insert blank supporting devices 152 and precut or pre-molded shoe insert blanks 156 are formed with upwardly sloped portions forward of the vertical reference planes 32 and with suitable blend radii 162 formed between forefoot supporting and trailing portions 158 and 160. In any case, a particular set of shoe insert blank supporting devices 152 is selected based upon maintenance of the minimum clearance between them and the composite digitized foot impressions 102 and then mounted on the table 154.

An appropriate pair of shoe insert blanks 156 is positioned and held in the shoe insert blank supporting devices 152 with reference to an alignment apparatus (not shown) similar to foot alignment apparatus 56 that described above for locating the consumer's feet. Next the desired shoe insert contours including forefoot supporting portions 61 and trailing portions 63 are cut into the pair of shoe insert blanks 156 in conformance with the composite digitized foot impressions 102 according to the procedures described above. In addition, forward most portions 164 of the shoe insert contours (e.g., forward of the lowest points of the toe supporting contours) are cut parallel to the forefoot supporting portions 158.

However, it is important to realize that the goal behind forming the shoe inserts 62 is to fill the volumetric space between contours representative of the consumer's composite digitized foot impressions 102 and the actual geometry of the insert mounting surfaces in his or her shoes. Thus, in either method of forming shoe inserts 62 the polygonal master model files used for forming a pair of shoe insert contours should be corrected for accommodating non-flat insert mounting surfaces. Seemingly this correction is never applied in present practice. It is quite important however because otherwise the somewhat pliable material used for the shoe inserts 62 will conform to such non-flat insert mounting surfaces and thus deleteriously modify the foot supporting contours of the shoe inserts 62.

Although it would be ideal if all shoe manufacturers made shoes from shoe lasts having flat reference surfaces in their trailing portions and cylindrically curving forefoot supporting portions, and/or were at least consistent in their last proportions, in the real world they most certainly do not. Generally, shoe lasts are formed with a relatively sharp concave bend under the rear of the instep in conjunction with an otherwise generally convex shape in an attempt to accommodate "average" feet in shoes made therefrom. Proportions of the instep and heel areas vary widely even within identical width designations.

Thus, it is necessary to obtain typical shoe last bottom geometry utilized for a representative shoe size for each shoe type utilized. This information is stored in polygonal master model files and then scaled over various shoe sizes and widths when processing pairs of shoe inserts 62 for different consumers having a range of foot sizes. The scaled information is incorporated into each personal file by subtracting so generated shoe reference surface polygonal model files from the polygonal master model files comprised within the composite set of digitized foot impressions 102. Thus, an individual pair of shoe inserts 62 should ideally be utilized in each type of shoe a consumer wears. In any case, the shoe insert contours are in fact formed in the digitally controlled milling machine 136 in conformance with the data indicative of the consumer's set of composite digitized foot impressions 102 less the scaled corrections of the selected one of the typical shoe last bottom geometries.

While it is certainly possible to inventory an enormous selection of shoe insert blanks 156 and the very wide assortment of shoe insert blank supporting devices 152 necessary for holding them on the table 154, or alternately to hand form the edge contours of the resulting shoe inserts 62 to fit individual shoes, it is believed preferable herein to utilize a minimal number of oversize shoe insert bank sizes and then form the edge contours 166 of the shoe inserts 62 with a router head 168 and cutter 170 also mounted on the digitally controlled milling machine 136. This requires a gimbal mounted router head 168 mounted in juxtaposition with the digitally controlled milling machine's milling spindle 140. Thus in conjunction with the X, Y and Z axes of the digitally controlled milling machine 136, the gimbal mounted router head 168 concomitantly enables the digitally controlled milling machine 136 to be operated as a 5-axis router.

The cutter 170 utilized for cutting the edge contours 166 of the shoe inserts 62 is actually a dovetail cutter 170 comprising a sharp apex 172. The dovetail cutter 170 is configured with a dovetail cutter angle 174 greater than any anticipated instep contour angle 176. This results in the gimbal-mounted router head 168 always being angled inward as the dovetail cutter 170 cuts the edge contours of the shoe insert blanks 156. The 5-axis router function of the digitally controlled milling machine 136 is programmed such that the sharp apex 172 of the dovetail cutter 170 just misses the shoe insert blank supporting devices 152 and leaves a slight amount of "flash" surrounding the bottom surface of the shoe inserts 62. After the edge contours 166 are formed in this manner, the shoe inserts 62 are removed from the shoe insert blank supporting devices 152 and the flash is removed by hand methods. Then the contoured top surfaces of the shoe inserts 62 are covered with material suitable for interfacing with the feet. Finally, the finished pair of shoe inserts 62 is presented or shipped to the consumer.

Figure 13:
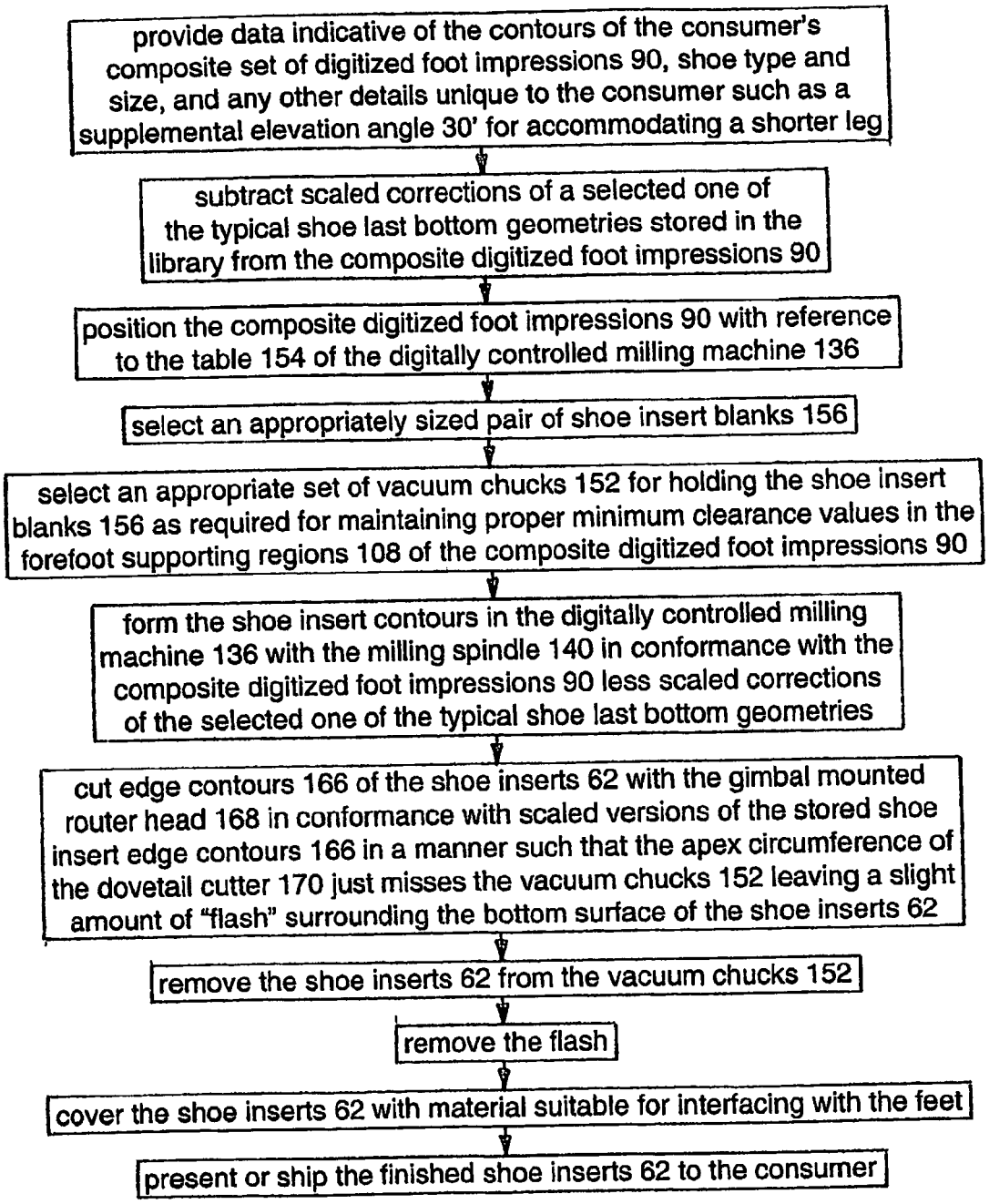
FIG. 13 is a flow chart depicting a preferred method of forming shoe inserts from shoe insert blanks.

In accordance with a flow chart depicted in FIG. 13 then, a preferred method of forming shoe inserts 62 for a consumer via utilization of a digitally controlled milling machine 136 equipped with a laterally rotated milling spindle 140 and a dovetail cutter 142 having an apex radius 146 smaller than any anticipated shoe insert feature radius along with a gimbal mounted router head 168 with a dovetail cutter 170 having a dovetail cutter angle 174 greater than any anticipated instep contour angle 176, and having a software library of typical shoe last bottom geometries and typical shoe insert edge contours 166, wherein the method comprises the steps of: providing data indicative of the contours of the consumer's composite set of digitized foot impressions 102, shoe type and size, and any other details unique to the consumer such as a supplemental elevation angle 30' for accommodating a shorter leg; subtracting scaled corrections of a selected one of the typical shoe last bottom geometries stored in the library from the composite digitized foot impressions 102; positioning the composite digitized foot impressions 102 with reference to the table 154 of the digitally controlled milling machine 136; selecting an appropriately sized pair of shoe insert blanks 156; selecting an appropriate set of shoe insert blank supporting devices 152 for holding the shoe insert blanks 156 as required for maintaining proper minimum clearance values in the forefoot supporting regions 108 of the composite digitized foot impressions 102; forming the shoe insert contours in the digitally controlled milling machine 136 with the milling spindle 140 in conformance with the composite digitized foot impressions 102 less scaled corrections of the selected one of the typical shoe last bottom geometries; cutting edge contours 166 of the shoe inserts 62 with the gimbal mounted router head 168 in conformance with scaled versions of the stored shoe insert edge contours 166 in a manner such that the apex circumference of the dovetail cutter 170 just misses the shoe insert blank supporting devices 152 leaving a slight amount of "flash" surrounding the bottom surface of the shoe inserts 62; removing the shoe inserts 62 from the shoe insert blank supporting devices 152; removing the flash; covering the shoe inserts 62 with material suitable for interfacing with the feet; and presenting or shipping the finished shoe inserts 62 to the consumer.

Figure 14:
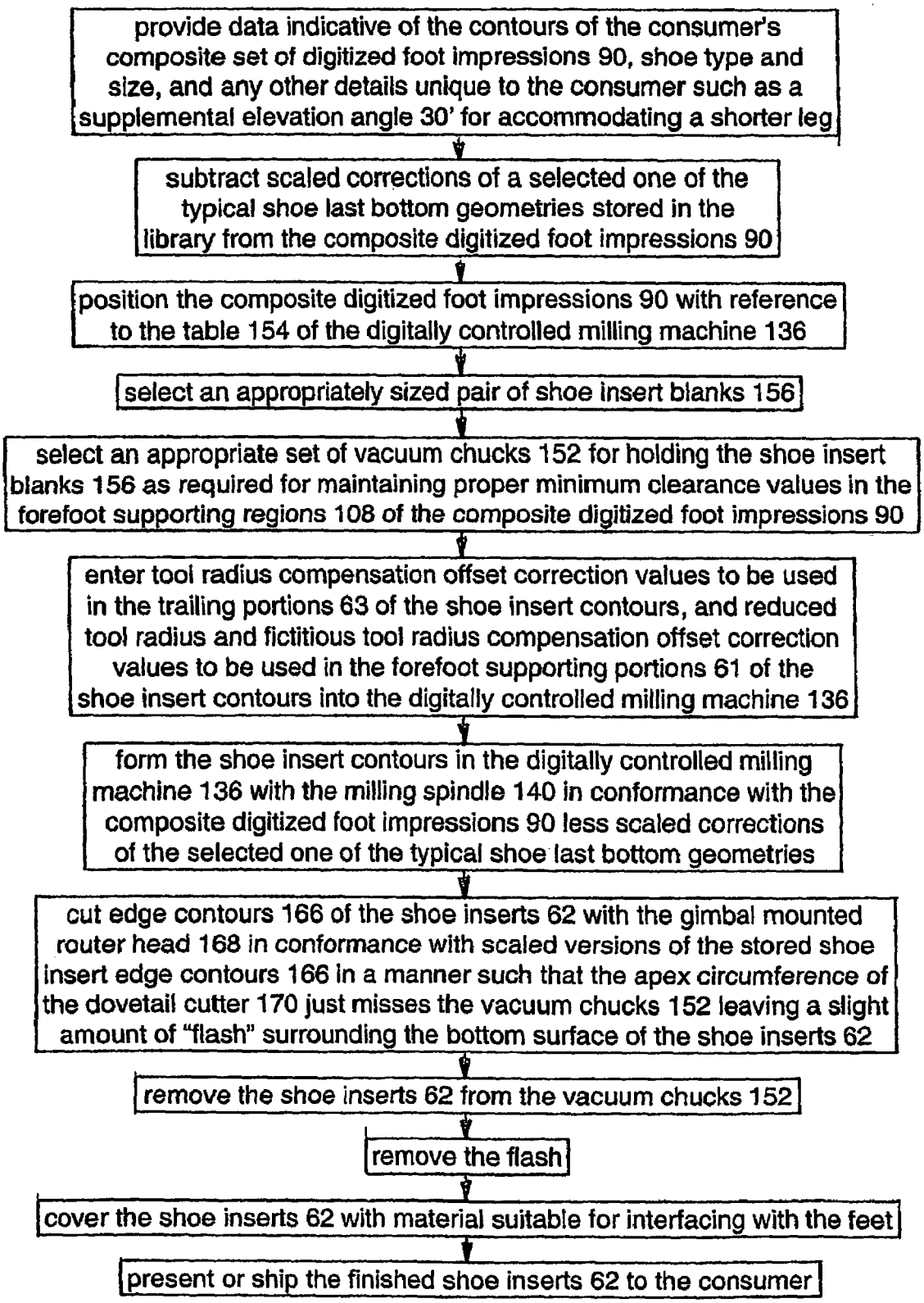
FIG. 14 is a flow chart depicting an alternate preferred method of forming shoe inserts from shoe insert blanks.

In accordance with a flow chart depicted in FIG. 14, an alternate preferred method of forming shoe inserts 62 for a consumer via utilization of a digitally controlled milling machine 136 equipped with a laterally rotated milling spindle 140 and a dovetail cutter 142 having an apex radius 146 smaller than any anticipated shoe insert feature radius along with a gimbal mounted router head 168 with a dovetail cutter 170 having a dovetail cutter angle 174 greater than any anticipated instep contour angle 176, and having a software library of typical shoe last bottom geometries and typical shoe insert edge contours 166, wherein the method comprises the steps of: providing data indicative of the contours of the consumer's composite set of digitized foot impressions 102, shoe type and size, and any other details unique to the consumer such as a supplemental elevation angle 30' for accommodating a shorter leg; subtracting scaled corrections of a selected one of the typical shoe last bottom geometries stored in the library from the composite digitized foot impressions 102; positioning the composite digitized foot impressions 102 with reference to the table 154 of the digitally controlled milling machine 136; selecting an appropriately sized pair of shoe insert blanks 156; selecting an appropriate set of shoe insert blank supporting devices 152 for holding the shoe insert blanks 156 as required for maintaining proper minimum clearance values in the forefoot supporting regions 108 of the composite digitized foot impressions 102; entering tool radius compensation offset correction values to be used in forming the trailing portions 63 of the shoe insert contours, and reduced tool radius and fictitious tool radius compensation offset correction values to be used in forming the forefoot supporting portions 61 of the shoe insert contours into the digitally controlled milling machine 136; forming the shoe insert contours in the digitally controlled milling machine 136 with the milling spindle 140 in conformance with the composite digitized foot impressions 102 less scaled corrections of the selected one of the typical shoe last bottom geometries; cutting edge contours 166 of the shoe inserts 62 with the gimbal mounted router head 168 in conformance with scaled versions of the stored shoe insert edge contours 166 in a manner such that the apex circumference of the dovetail cutter 170 just misses the shoe insert blank supporting devices 152 leaving a slight amount of "flash" surrounding the bottom surface of the shoe inserts 62; removing the shoe inserts 62 from the shoe insert blank supporting devices 152; removing the flash; covering the shoe inserts 62 with material suitable for interfacing with the feet; and presenting or shipping the finished shoe inserts 62 to the consumer.

Having described the invention, however, many modifications will become immediately apparent to those skilled in the art to which it pertains, without deviation from the spirit of the invention. This is especially true with regard to specific subsystem choices. For instance, some other type of scanning means (e.g., other than the non-contacting scanning means 88) could be used for digitally recording contours of the foot impressions 18. Such modifications clearly fall within the scope of the invention.

COMMERCIAL APPLICABILITY

As already mentioned above, it is believed herein that it is simply not possible to obtain satisfactory shoe inserts from any source at this time. Clearly then, it is desirable to provide apparatus and methods for implementing more accurate and reproducible foot impressions and for forming shoe inserts of generally improved composite contours having specific application targeted geometries that are practical for manufacture and thus suitable for sale and distribution to consumers. Accordingly, it is believed herein that the apparatus and methods for taking impressions of the feet and forming shoe inserts therefor described above will find commercial application in the shoe industry in general and with podiatrists in particular both in America and abroad.

The invention claimed is:

1. A foot impression generating apparatus for enabling formation of foot impressions, comprising:

impression platforms including buns of blown open-cell sponge material bonded to and supporting non-porous skins formed of non-blown sponge material wherein the sponge material comprises elastomeric and thermoplastic materials, and wherein the buns and skins are mounted upon a pair of bases having forefoot supporting and angularly elevatable trailing portions; and heating and cooling means for heating the impression platforms to a temperature slightly above the melting temperature of the thermoplastic material and then cooling the impression platforms to a temperature below that of the low temperature end of the plastic range of the thermoplastic material;

wherein said heating and cooling means have:

a blower equipped with a heating coil similarly to a hair dryer for providing heated and then ambient air to the impression platforms;

inlet and exhaust vents for circulating the heated and then ambient air through the open-cell sponge material;

a temperature transducer for providing a signal indicative of the temperature of the heated air; and a temperature controller for maintaining the heated air at a selected temperature slightly above the melting temperature of the thermoplastic material in response to the signal from the temperature controller, wherein a flow of the heated air is provided via turning the blower on and controlling a electrical current flowing through the heating coil, and then a flow of cooling ambient air is provided by turning the electrical current off.

2. The foot impression generating apparatus of claim 1, further comprising a damper activated air re-circulation system for recovering heated air and re-circulating it through the open-cell sponge material.

3. A method of creating foot impressions representative of the bottom foot contours of a consumer's feet via utilization of foot impression generating apparatus configured in accordance with claim 1 wherein the method comprises the steps of:

heating the impression platforms slightly above the melting temperature of the thermoplastic material;

angularly elevating the trailing portions to a selected angular elevation angle representative of the selected foot impression forming position;

the consumer stepping into the impression platforms thereby deforming the buns and skins in an elastomeric manner and thus forming foot impressions in conformance with the shape of his or her feet at the selected foot impression forming position;

cooling the impression platforms to a temperature below that of the low temperature end of the plastic range of the thermoplastic material; and the consumer removing his or her weight and feet from the impression platforms thus leaving the consumer's foot impressions as taken at the selected foot impression forming position.

4. The foot impression generating apparatus of the claim 1 additionally comprising non-contacting scanning means for creating digital "point cloud data" representative of the foot impressions.

5. A method of creating digitized foot impressions representative of the bottom foot contours of a consumer's feet via utilization of foot impression generating apparatus configured in accordance with claim 4 wherein the method comprises the steps of:

heating the impression platforms slightly above the melting temperature of the thermoplastic material;

angularly elevating the trailing portions to a selected angular elevation angle representative of the selected foot impression forming position;

the consumer stepping into the impression platforms thereby deforming the buns and skins in an elastomeric manner;

cooling the impression platforms to a temperature below that of the low temperature end of the plastic range of the thermoplastic material;

the consumer removing his or her weight and feet from the impression platforms;

scanning the contours of the foot impressions;

creating digital data representative of the contours of the foot impressions as formed at the selected foot impression forming position; and storing the digital data as digitized foot impressions.

6. The foot impression generating apparatus of claim 4 further comprising foot alignment means having lateral positioning gates juxtaposed to selected foot impression positions for a consumer's great toe metatarsal heads, and adjustable form fitting longitudinal gates juxtaposed to selected foot impression positions for the rear of the consumer's heels.

7. A method of creating digitized foot impressions representative of the bottom foot contours of a consumer's feet via utilization of foot impression generating apparatus configured in accordance with claim 6 wherein the method comprises the steps of:

measuring the distances between the great toe metatarsal heads and the rear of the heels of the consumer's feet;

setting the foot alignment apparatus in a matching manner;

heating the impression platforms slightly above the melting temperature of the thermoplastic material;

angularly elevating the trailing portions to a selected angular elevation angle representative of the selected foot impression forming position;

positioning the impression platforms to an initial position whereat the trailing portions are nominally horizontal;

further angularly elevating either trailing portion at an appropriate supplemental elevation angle in order to compensate for a short leg in the event that the consumer has one leg shorter that the other;

the consumer aligning his or her feet with reference to the foot alignment apparatus before stepping into the impression platforms;

the consumer stepping into the impression platforms thereby deforming the buns and skins in an elastomeric manner;

forwardly rotating the impression platforms to the selected foot impression forming position whereat the consumer forms foot impressions in conformance with the shape of his or her feet at the selected foot impression forming position;

re-measuring the distances between the great toe metatarsal heads and the rear of the heels of the consumer's feet with the foot alignment apparatus;

cooling the impression platforms to a temperature below that of the low temperature end of the plastic range of the thermoplastic material;

rotating the back to its initial position;

the consumer removing his or her weight and feet from the impression platforms;

scanning the contours of the foot impressions;

creating digital data representative of the contours of the foot impressions as formed at the selected foot impression forming position; and storing the digital data as digitized foot impressions along with the re-measured distances between the great toe metatarsal heads and the rear of the heels of the consumer's feet as a set of data representative of the contours of the consumer's foot impressions as taken at the selected foot impression forming position.

8. A method of creating a composite set of digitized foot impressions representative of a selected blending of at least two sets of data representative of the contours of a consumer's foot impressions, where each of the at least two sets of data have previously been determined at selected foot impression forming positions according to the method of claim 7, comprises the steps of:

compressionally distorting the digitized foot impression or impressions data comprised in the set or sets of data representative of the contours of a consumer's foot impressions taken at the lessor trailing portion angle or angles over the rear portion of the distance from the great toe metatarsal heads to the rear of the heels such that the resulting distance between the great toe metatarsal heads and the rear of the heels comprised in the set or sets of the so modified digitized foot impression data is or are equal to that of the set of data representative of the contours of the consumer's foot impressions taken at the greater trailing portion angle;

positioning the sets of so modified digitized foot impression data progressively along the longitudinal axis of the composite set of digitized foot impressions with the digitized data from the set of data representative of the contours of the consumer's foot impressions taken at the largest trailing portion angle positioned forwardly and those taken at the smallest trailing portion angle rearwardly with the respective sets of digitized data generally disposed to either side of a mean average angularly skewed line or lines extending from inside to outside of the composite set of digitized foot impressions in a generally forward direction or directions; and establishing transition zones on either side of the mean average line or lines such that there is a smooth transition between digitized data from the set of data representative of the contours of the consumer's foot impressions taken at the largest trailing portion angle generally present from the forward portion of the instep through the forefoot supporting regions to digitized data from the set of data representative of the contours of the consumer's foot impressions taken at the smallest trailing portion angle generally present from the rear of the fifth metatarsal through the heel regions, with the fully implemented composite set of digitized foot impressions along with the consumer's identification, shoe type and size, and any supplemental elevation angle utilized in a personal file ready for use in shoe insert generating apparatus.

* * * * *

UNITED STATES PATENT AND TRADEMARK OFFICE

CERTIFICATE OF CORRECTION

PATENT NO. : 7,657,054 B2
APPLICATION NO. : 10/524093
DATED : February 2, 2010
INVENTOR(S) : Edward H. Phillips It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1395 days.

Signed and Sealed this

Thirtieth Day of November, 2010

David J. Kappos

David J. Kappos
*Director of the United States Patent and Trademark Office*